US007413380B2

(12) United States Patent
Corwon et al.

(10) Patent No.: US 7,413,380 B2
(45) Date of Patent: Aug. 19, 2008

(54) GOLF COURSE TURF CONDITIONING CONTROL SYSTEM AND METHOD

(75) Inventors: Michael E. Corwon, Aiken, SC (US); Michael K. Crowe, Evans, GA (US); Robert F. Bishop, Jr., Aiken, SC (US)

(73) Assignee: SubAir Systems, LLC, Graniteville, SC (US)

( * ) Notice: Subject to any disclaimer, the term of this patent is extended or adjusted under 35 U.S.C. 154(b) by 0 days.

(21) Appl. No.: 11/496,902

(22) Filed: Aug. 1, 2006

(65) Prior Publication Data

US 2007/0237583 A1 Oct. 11, 2007

(51) Int. Cl.
*E02B 11/00* (2006.01)
*A01G 9/24* (2006.01)

(52) U.S. Cl. ..... 405/37; 405/43; 405/45; 47/1.01 R; 47/58.1 R; 137/78.3; 700/284; 239/63

(58) Field of Classification Search ..... 405/37, 405/43, 45, 269, 258; 47/1.07, 12, 58.112, 47/107.12, 107 F; 137/78.1–78.3, 79; 37/58.1 R; 700/284; 239/63–65
See application file for complete search history.

(56) References Cited

U.S. PATENT DOCUMENTS

| | | | |
|---|---|---|---|
| 3,599,867 | A | 8/1971 | Griswold et al. |
| 3,726,477 | A | 4/1973 | Shapiro |
| 4,194,691 | A | 3/1980 | Birnbach et al. |
| 4,244,022 | A | 1/1981 | Kendall |
| 4,293,237 | A | 10/1981 | Robey et al. |
| 4,626,984 | A | 12/1986 | Unruh et al. |
| 5,148,125 | A | 9/1992 | Woodhead et al. |
| 5,219,243 | A | 6/1993 | McCoy |
| 5,358,180 | A | 10/1994 | Prassas et al. |
| 5,433,759 | A | 7/1995 | Benson |
| 5,507,595 | A | 4/1996 | Benson |

(Continued)

FOREIGN PATENT DOCUMENTS

| | | |
|---|---|---|
| JP | 04051825 | 2/1992 |

OTHER PUBLICATIONS

Roy Dodd, Ph.D.; Bruce Martin, PhD.; James Camberato,Ph.D. "Subsurface cooling and aeration" Golf Course Management, Sep. 1999.

(Continued)

*Primary Examiner*—Frederick L Lagman
(74) *Attorney, Agent, or Firm*—McNair Law Firm; Cort Flint

(57) ABSTRACT

A system and method for conditioning turf at of one or more golf course areas includes an aeration subsystem having subsurface aeration conduits for aerating the area, and an air blower unit in fluid communication with the aeration conduits configured to provide one of a vacuum in a vacuum mode and air under pressure in a pressure mode in the conduits. A control module is provided which responds to a directive for controlling operation of the aeration subsystem in response to sensing environmental parameters. The control module operates the blower in repetitive cycles of intermittent operation in one of the vacuum mode and pressure mode wherein each cycles includes a blower-on and blower-off mode. The blower-on mode operates the blower units for a first time interval and the blower-off mode ceases operation of the blower units for a second time interval during each cycle.

50 Claims, 18 Drawing Sheets

U.S. PATENT DOCUMENTS

| | | | | |
|---|---|---|---|---|
| 5,542,208 | A | 8/1996 | Benson | |
| 5,596,836 | A | 1/1997 | Benson | |
| 5,617,670 | A | 4/1997 | Benson | |
| 5,634,294 | A | 6/1997 | Rohoza | |
| 5,636,473 | A | 6/1997 | Benson | |
| 5,697,187 | A | 12/1997 | Persinger | |
| 5,752,784 | A | 5/1998 | Motz et al. | |
| 5,924,238 | A | 7/1999 | Yonohara | |
| 5,944,444 | A | 8/1999 | Motz et al. | |
| 6,018,909 | A | 2/2000 | Potts | |
| 6,088,959 | A | 7/2000 | Wait et al. | |
| 6,220,957 | B1 | 4/2001 | Clarkson | |
| 6,273,638 | B1 | 8/2001 | Clarkson | |
| 6,357,175 | B1 | 3/2002 | Persinger | |
| 6,364,628 | B1 | 4/2002 | Potts et al. | |
| 6,918,404 | B2 | 7/2005 | Dias da Silva | |
| 6,997,642 | B2 | 2/2006 | Bishop, Jr. | |
| 7,012,394 | B2 | 3/2006 | Moore et al. | |
| 7,172,366 | B1 * | 2/2007 | Bishop, Jr. | 405/37 |

OTHER PUBLICATIONS

B. Todd Bunnell; Bert McCarty, Ph.D.; Roy Dodd, Ph.D. "Why is carbon dioxide bad in golf root zones?" Golf Course Management,Jun. 2000.

Robert H. Walker, Ph.D.; Zhaohu Li, Ph.D.; Glenn Wehtje, Ph.D. "Roots improve with summertime air movement beneath greens" GCM Aug. 2000.

J.J. Camberato, Ph.D.; R.B. Dodd, Ph.D.; S.B. Martin,Ph.D.; S.W. Godwin "Subsurface air injection improves bentgrass rooting and turf quality" GCM Sep. 2000.

Ian R. Rodriguez, M.S., Bert McCarty, Ph.D. "Helping creeping bentgrass stay cool: A review" Golf Course Management Sep. 2002.

* cited by examiner

FEATURES:

* AUTOMATIC CONTROL PROGRAM BASED ON TEMPERATURE & MOISTURE
* DATA-LOGGING & TREND CHARTING HISTORY

EQUIPMENT PANEL

LOCAL DISCONNECT (FUSED)
TRANSFORMER (IF 480 VAC SUPPLY)
MOTOR CONTACTOR
MOTOR OVERLOADS
CURRENT SWITCH
(CONTACT CLOSE @ > 2 AMPS)

RELAYS:
MOTOR START
AIR REVERSING VALVE & ACTUATOR
FOR ONE VAULT TO TWO GREENS
(DOUBLE VAULT)

DIVERTER ACTUATOR GREEN A
DIVERTER ACTUATOR GREEN B

PANEL DOOR SWITCH -
ON VACUUM / ON PRESSURE
PANEL DOOR FAULT LIGHT
(OVERLOAD / UNDERLOAD / FLOODED VAULT)
MOISTURE / TEMPERATURE SENSOR
(IF REQUESTED)

COMMUNICATION & CONTROL

OUTPUTS TO PANEL
BLOWER ON
AIR REVERSING VALVE TO PRESSURE
POSITION (AT REST IS VACUUM)
FOR ONE VALVE TO TWO GREENS

OPEN DIVERTER VALVE TO GREEN A
OPEN DIVERTER VALVE TO GREEN B

INPUTS FROM PANEL &FIELD DEVICES:
MOTOR OVERLOADS DROPPED OUT
CURRENT < 2 AMPS WHEN RUNNING

VAULT FLOODED
GREEN MOISTURE
GREEN TEMP
AMBIENT TEMPERATURE (IF REQUESTED)

LOGIC REQUIREMENTS:
BLOWER ON BASED ON - TIME OF DAY
BLOWER ON BASED ON - TEMPERATURE
& / OR MOISTURE (IF REQUESTED)
VACUUM TO GREEN
PRESSURE TO GREEN
GREEN A & / OR GREEN B (IF DOUBLE
VAULT)
SHUT DOWN / DO NOT START IF FLOODED

FIG. 12

GOLF COURSE TURF CONDITIONING CONTROL SYSTEM AND METHOD

CROSS-REFERENCE TO RELATED APPLICATIONS

This application claims priority to and the benefit of U.S. provisional patent application Ser. No. 60/447,169, filed Feb. 12, 2003; U.S. provisional patent application Ser. No. 60/447,218, filed Feb. 12, 2003; U.S. patent application Ser. No. 10/777,466, filed Feb. 12, 2004, now abandoned; U.S. patent application Ser. No. 10/777,491, filed Feb. 12, 2004, now abandoned; U.S. patent application Ser. No. 10/916,187, filed on Aug. 11, 2004, now U.S. Pat. No. 7,012,394; U.S. patent application Ser. No. 10/935,205, filed on Sep. 7, 2004; now U.S. Pat. No. 6,997,642 issued on Feb. 14, 2006; co-pending U.S. patent application Ser. No. 11/331,793, filed on Jan. 12, 2006; and co-pending U.S. patent application Ser. No. 11/400,862, filed on Apr. 10, 2006, each of which applications and/or patents is incorporated herein by reference in its entirety.

BACKGROUND OF THE INVENTION

The invention relates to turf conditioning systems and method, in general and particularly to an aeration subsystem servicing one or more areas of interest of a golf course having a control module providing intermittent cycles of turf aeration, and/or a simple electronic intermittent control circuit for doing the same to lower operating costs without sacrificing effectiveness.

Prior systems are known for treating soil and turf by blowing and/or sucking air through a perforated duct network located underneath the turf. A high-pressure high-volume air pump or blower unit arrangement is typically used to move air into the soil profile or remove moisture from the soil profile. For example, commonly owned U.S. Pat. Nos. 5,433,759; 5,507,595; 5,542,208; 5,617,670; 5,596,836; and 5,636,473, the disclosure of each of which is incorporated herein by reference, show different versions of equipment used for this purpose. Since an air pump or non-reversing blower discharges air from one connection and pulls in air from another, changing the system from a blowing function to a suction function requires disconnecting the duct network from the pressure outlet of the blower and connecting it to the suction inlet. For this purpose, various valves and/or couplings can be used to avoid the hassles involved with selectively connecting and disconnecting the duct network from the various ports of the blower. Manual operations limit the degree to which the usage can be automated. In addition, considerable judgment is involved in knowing when to blow air into the duct network and when to remove air from the duct network by applying a partial vacuum. For example, blowing air into the duct network when there is too much moisture in the soil profile can severely damage parts of the turf.

Commonly owned U.S. Pat. No. 6,273,638, the disclosure of which is incorporated herein by reference, discloses additional features of an air handling system that includes an air handling device connectable to a duct network that is underneath a grass field, at least one sensor disposed to measure a variable associated with the field, and a control module connected to the air handling device to control operating parameters of the air handling device responsive to an output from the sensor. The variables associated with the field include temperature and moisture. The operating parameters of the air handling device include direction of the air flow, temperature of the air directed into the duct network, and the time of operation of the unit. The system optionally includes programmable control logic so that the sensor output automatically controls the operating parameters of the system. The sensor output can be viewed on the computer display to allow a user to manually control the operating parameters if desired.

The prior turf treatment systems are most commonly known for the ability to remove excess water from the soil profile to improve playability on golf greens and sports fields. For example, a system manufactured by SubAir Systems of Graniteville, S.C., has been featured during major golf tournaments citing its ability to quickly return the greens to firm and fast conditions and for keeping fairways and pedestrian areas free from standing water. This feature minimizes downtime in play and makes the course safer for spectators during times of inclement weather.

Some sports fields, including the soccer field of Manchester United (U.K.), the soccer field of Kilmarnock (U.K.), the baseball and softball fields at the University of Nebraska, and the football field of the Denver Broncos in Denver, Colo., have employed similar methods of operation to those described herein. However, the varied conditions found in golf courses are appreciably different from the conditions found in a single unvarying expanse such as a football, a baseball, a softball or a soccer field, requires novel application of the systems and methods to golf courses.

Not as well known in managing golf course turf are the agronomic benefits that are obtained by introducing fresh air into the soil profile. Fresh air is introduced in the profile whenever excess moisture is removed. Excess moisture and low levels of oxygen are major contributors to turf disease. Turf can suffer even when the level of moisture in the soil profile is not excessive due to poor air quality within the soil profile. There are several reasons for this owing to the fact that plant roots require oxygen for respiration. Through the process of respiration the plant uses up available oxygen located in the pore space between sand particles in the profile and replaces it with carbon dioxide. The deterioration of soil air quality is accelerated when the plant is under stress since the rate of plant respiration increases. Oxygen is also depleted and additional gases are generated as a byproduct of decomposing organic matter within the soil profile due to microbial activity. Microbial activity will vary depending on weather conditions with warm, moist weather being the ideal. Lastly, gases such as methane and hydrogen sulfide may exist in surrounding soil naturally. Because soil air quality can vary independent of soil moisture levels it is beneficial to exchange soil gases on a regular and frequent basis to ensure optimum growing conditions for turf. However, the general industry practice has migrated to turf treatment primarily after rain events. Some golf courses do turf treatments once or twice a week, but this will not achieve optimal results especially when the turf is under stress.

Accordingly, an object of the present invention is to provide an automatic turf conditioning system which can not only remove excess water from golf greens and the like, but can condition the root zone to promote healthy grass as well.

Another object of the invention is to automatically control aeration of a soil profile growing sports turf to increase the oxygen and reduce carbon dioxide in the profile to promote the healthy growth of turf.

SUMMARY OF THE INVENTION

The above objectives are accomplished according to the present invention by providing a system and method for conditioning and oxygenating turf of a playing field, such as golf course greens, having a soil profile which includes an aeration subsystem having a plurality of perforated aeration conduits disposed below the turf in fluid communication with the turf. An air blower unit is operatively connected to the aeration conduits for establishing one of a vacuum in a vacuum mode and air under pressure in a pressure mode in the conduits. A control module controls the operation of the blower unit to establish one of the vacuum mode and pressure mode in the aeration conduits in response to sensing an ambient air temperature. Advantageously, the control module operates the blower unit in repetitive cycles of intermittent operation wherein each cycle includes a blower-on mode and a blower-off mode during the one of a vacuum mode and pressure mode. The blower-on mode operates the blower for a first time interval and the blower-off mode discontinues operation of the blower for a second time interval during each of the cycles.

A simplified form of the invention may be advantageously provided when one or more areas are being controlled individually rather than from a central location. In this case, the control module may consist of a simplified intermittent control circuit for automatically controlling the operation of the blower unit. The control circuit may include a repeat cycle timer for operating the blower unit in repeat cycles of intermittent operation. A thermal switch circuit is connected to the cycle timer for operating the blower unit in response to the ambient air temperature in one of a vacuum mode and a pressure mode during the cycles of intermittent operation. The cycle timer operates the blower for a first time interval in the blower-on mode and ceases operation of the blower for a second time internal during each repeat cycle. The intermittent control circuit preferably includes a time delay circuit for delaying operation of the blower unit in a pressure mode to provide ample time for the blower unit to be mechanically reconfigured for pressure mode operation.

The system advantageously includes a first air setpoint and a second air setpoint. The control module initiates the cycles of intermittent operation when the ambient temperature is generally greater than the first air setpoint. The controller module initiates the intermittent operation in the vacuum mode when the ambient air temperature is generally less than the second air setpoint, and initiates operation of the intermittent operation in the pressure mode when the ambient air temperature is generally greater than the second air setpoint. The intermittent operation runs continuously, however, the control module terminates the intermittent operation in response to detecting one of a predetermined environmental condition and operational condition. The environmental condition may include one of a condition of a soil moisture content and an ambient air temperature. The operational condition may include one of an overriding operation of the aeration subsystem selected by an attendant and a scheduled operation event.

In a more fully automated version of the invention, the environmental parameters preferably include ambient air temperature and a soil temperature. There are first and second air setpoints representing prescribed ambient air temperatures, and first and second soil setpoints representing prescribed soil temperatures. The control module controls the blower units in a mode of intermittent operation in response to comparing the ambient air temperature to the first and second air setpoints, and comparing the soil temperature to the first and second soil setpoints. The control module operates the intermittent operation in the vacuum mode when the ambient air temperature is generally greater than the first air setpoint and the soil temperature is generally less than the second soil setpoint. Intermittent operation in the pressure mode is initiated when the ambient air temperature is generally greater than the first air setpoint and the soil temperature is generally greater than the first soil setpoint.

More particularly, the control module initiates the intermittent operation of the aeration subsystem in the vacuum mode when one of the following occurs (1) the ambient temperature is generally greater than the second air setpoint and the soil temperature is generally less that the first soil setpoint, (2) the ambient temperature is generally less than the first air setpoint and the soil temperature is generally greater than the second soil setpoint, (3) the ambient temperature is generally greater than the first air setpoint and generally less than the second air setpoint, and the soil temperature is generally less than the first soil setpoint, (4) the ambient temperature is generally greater than the first air setpoint and generally less than the second air setpoint, and the soil temperature is generally greater than the second soil setpoint, and (5) the ambient temperature is generally greater than the first air setpoint and generally less than the second air setpoint, and the soil temperature is generally greater than the first soil setpoint and generally less than the second soil setpoint.

In regard to the pressure mode, the control module initiates intermittent operation in the pressure mode when one of the following occurs (1) the ambient temperature is generally greater than the second air setpoint and the soil temperature is generally greater than the second soil setpoint, (2) the ambient temperature is generally less than the first air setpoint and the soil temperature is generally greater than the first soil setpoint and generally less than the second soil setpoint, (3) the ambient temperature is generally greater than the second air setpoint and the soil temperature is generally greater than the first soil setpoint and generally less than the second soil setpoint, (4) the ambient temperature is generally greater than the first air setpoint and generally less than the second air setpoint, and the soil temperature is generally greater than the second soil setpoint.

A computerized method for conditioning and oxygenating turf at an area of interest within a golf course comprises the steps of providing an aeration subsystem at the golf course area which includes a perforated aeration conduit disposed below the turf, a blower unit in fluid communication with the aeration conduit configured to establish one of a vacuum in a vacuum mode and air under pressure in a pressure mode in the aeration conduit, a control module for controlling operation of the aeration subsystem, and a sensor that measures the ambient air temperature. The method determines whether a condition exists for treating the soil at the area in response to the ambient air temperature. If the condition exists, the method operates the aeration subsystem to create one of a vacuum mode and a pressure mode in the aeration conduit for one of reducing or increasing a temperature of turf at the area. Quite advantageously, the method operates the blower units in repetitive cycles of intermittent operation during one of the vacuum mode and pressure mode wherein each cycle includes a blower-on mode and a blower-off mode. The blower-on mode operates the blower units for a first time interval and the blower-off mode discontinues operation of the blower units for a second time interval during each of the repetitive cycles.

The method operates the intermittent operation in the vacuum mode when the ambient air temperature is generally greater than the first air setpoint and the soil temperature is generally less than the second soil setpoint. The method operates the intermittent operation in the pressure mode when the ambient air temperature is generally greater than the first air setpoint and the soil temperature is generally greater than the first soil setpoint.

BRIEF DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 12 is an enumeration of some of the components, communication and control channels, and logic structure of one or more embodiments of the golf course environmental management system, according to principles of the invention;

DETAILED DESCRIPTION OF A PREFERRED EMBODIMENT

The systems and methods according to the present invention are useful in managing the operation of aeration subsystems at a plurality of locations, for example areas having different requirements from one another. Different areas on a golf course can have differences in many features, such as in topography, in elevation, in exposure to the sun, and in other features such as water table level, or being subject to wind. For example, a first green is surrounded by a water hazard (for example, a green situated on an island surrounded by water and accessible by a footbridge or golf cart path); a second green is surrounded by sand traps; a third green is exposed to full sun for much or all of a day; and a fourth green is surrounded by trees that shade the green from direct sunlight for a considerable part of the day. Different greens may have different soil conditions and/or different elevations, some may be sloped or terraced; and some may be subject to other unique conditions, such as prevailing winds, or exposure to salt water or salt spray (for example a course situated at the ocean).

Figure 1:
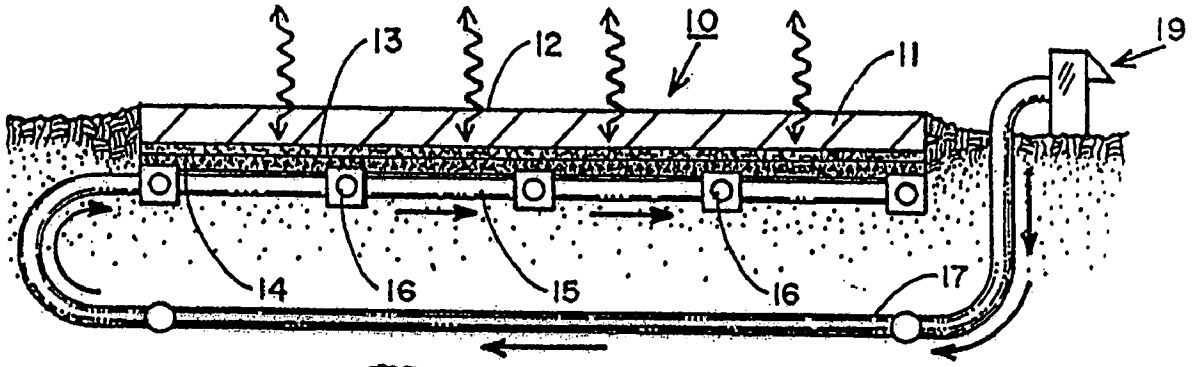
FIGS. 1 and 2 illustrate known prior art systems for treating soil and turf by supplying or removing air through a duct network disposed underneath the turf of a sports playing field or golf green.
Figure 2:
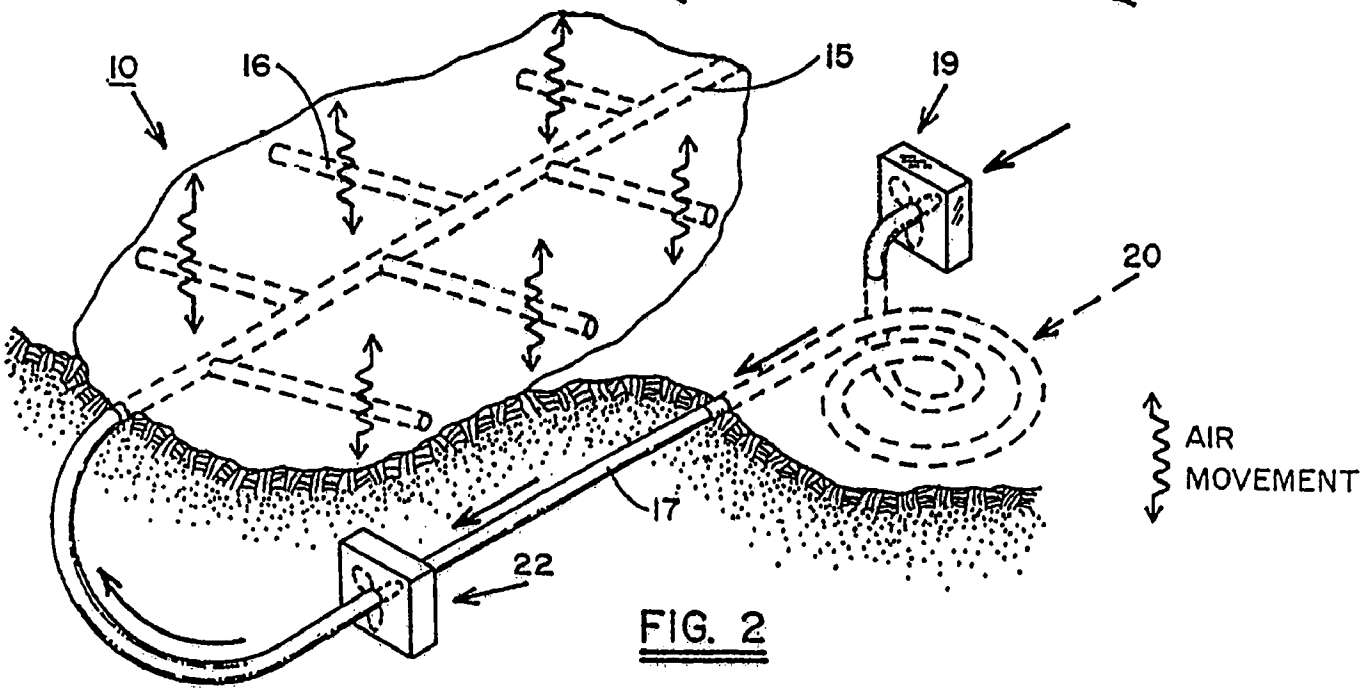
FIG. 2 PRIOR ART

Turning to FIGS. 1 and 2, there is shown a known system for temperature moderation of a golf course green generally referenced 10, as disclosed in U.S. Pat. No. 5,433,759. Although the present invention will be explained in detail with reference to the treatment of the turf and subsoil of a golf green, it will be understood, of course, that the present invention can be used in many other similar applications. Outdoor sports stadiums having grass playing fields are examples of sites where subsurface soil treatment is desirable.

The green depicted in FIG. 1 is one that has been constructed in compliance with the specifications of the United States Golf Association (USGA). The green includes a top layer 11 that supports a grass turf 12. The top layer may be about twelve inches deep and contain a mix that is 80% fine sand and 20% organic matter which is typically peat moss. Immediately below the top layer may be an intermediate layer 13 that is about two to four inches deep and contains the sand. Finally, a lower layer 14 of pea gravel about four inches deep is placed directly below the sand layer(s).

Typically, buried in the subsoil of the green is a duct network that is in communication with the lower level gravel bed and serves to carry excess water in the subsoil region away from the green. The duct network includes one or more main feeder lines 15 that are interconnected to a series of distribution lines 16. In the embodiment shown, the lines are arranged in a herringbone pattern that encompasses the green area. In another embodiment, the lines can be arranged as a series of parallel pipes connected along a common border or edge. The lines have openings that permit excess moisture in the soil to be collected in the lines. The lines are laid in the ground so that the collected moisture is gravity fed to the drainage system servicing the golf course. As will be explained in greater detail below, in accordance with the present invention, existing duct network can be retrofitted to the present system to provide underground heating, cooling and other beneficial treatment to the subsoil and turf of the green.

As shown in FIG. 1, the main feeder lines 15 are connected to a supply line 17 which, in turn, is connected to the outlet side of a blower 19. A portion of the supply line, shown in FIG. 1 as a linear section, is buried below the surface of the ground at a depth wherein the ground temperature is relatively constant and not readily responsive to changes in ambient air temperature, for example at a depth of between two and ten feet. The length of the linear section is such that sufficient energy is exchanged between the ground and the air moving through the line to bring the air temperature close to the ground temperature. The linear section of the line thus acts as a ground source heat pump to either heat or cool the air moving through the line, depending upon the temperature of ambient air drawn into the blower unit as compared to the ground temperature. In one mode, warm air under pressure is cooled from the initial ambient air temperature by virtue of conductive heat transfer to the subsurface aeration conduit and subsurface media (sand, soil, gravel, stone) when the conduit and the media are at a lower temperature than the ambient air temperature. The cooled air moves through the soil at the area of interest and reduces this soil temperature by virtue of conductive heat transfer. In another mode, ambient air under pressure is warmed in the conduit for increasing the heat of the soil profile when the ambient air temperature is lower than conduit and media temperatures.

In the event the ambient air temperature is relatively high, and the soil temperature surrounding and just below the turf is relatively high, the air will be cooled as it moves through the relatively cooler subsurface soil and gravel beneath the turf thus providing cooling to the turf area or area of interest. If the ambient air temperature is relatively low, and the soil temperature surrounding and just below the turf is relatively low, the air moving through the system will be increased by the relatively warmer subsurface soil thus providing heating to he turf area.

As disclosed in U.S. Pat. No. 5,433,759, a reversing valve unit has a first position when the blower is providing cooling or heated air to the duct network under the turf. Ambient air is delivered to the blower via an inlet line and the blower air discharge is pushed through the heat exchanger and the duct network. Reversing the valve positions causes the blower to draw ambient air downwardly through the green soil profile. When air is being pumped into the duct network, a predetermined volume of air is delivered under pressure through the pipe line into the gravel bed so that the air is distributed uniformly throughout the bed and then driven upwardly to penetrate the entire soil profile. The flow of air through the soil is employed to either heat or cool the turf, depending on the prevailing ambient air and ground conditions. The flow of air through the soil also provides an added benefit in that it serves to aerate the soil and thus promotes the health and growth of the grass turf. When the suction side of the blower is connected with pipe lines in the duct network, a sufficient suction or partial vacuum is provided to draw ambient air downwardly through the soil profile into the gravel distribution bed to again provide the desired heating or cooling of the grass turf. A further benefit of the suction mode of operation is that it affords rapid removal of excess water from the soil profile during periods of heavy rain or flooding. Excess water in the soil is drawn quickly down into the gravel bed and collected in the pipe lines. As disclosed in U.S. Pat. No. 5,507,595, the moisture laden air stream may be drawn into a water separator unit where the moisture and any airborne particulates are removed from the air stream and delivered to a holding tank without interrupting the operation of the blower. The apparatus can, in addition, continuously collect and drain moisture when operating in the pressure or suction mode. Alternatively, the blower operation may be terminated periodically for a short period of time allowing any water collected in the duct lines to be gravity fed to the drain system, where the water can flow away from the green or other area of interest.

As used herein, the term "directive," as used herein, is intended to mean an instruction from the programmable master control module to a local control module. The term "command" as used herein is intended to mean a computer instruction of a program operating on a computer or an instruction of a control logic sequence of a logic controller, or a user command for the programmable master control module. A user who issues directions of any kind to a local control module directly can be understood to have issued a directive even if the word "command" is used to express the user's action. The term "actionable condition" as used herein is intended to mean that some environmental condition (such as a temperature or a moisture content) is out of tolerance and needs to be corrected by operating the system, but does not imply anything about the condition of the subsurface aeration components. The term "setpoint" as used herein in intended to mean a value set by default, by a computer program, or by an operator to define a desired value of a parameter or condition, or an extremum of a range of acceptable values. An actionable condition occurs when a setpoint is deviated from, or an extreme of a range is exceeded.

Referring now to the drawings, an illustrated embodiment of a golf course turf conditioning control system and method for managing a plurality of golf course areas will now be described in more detail. The system and method of the invention use one or more sensors to provide area information about the state of various environmental variables, such as an ambient air temperature, a soil temperature, and/or a soil moisture content.

Figure 3:
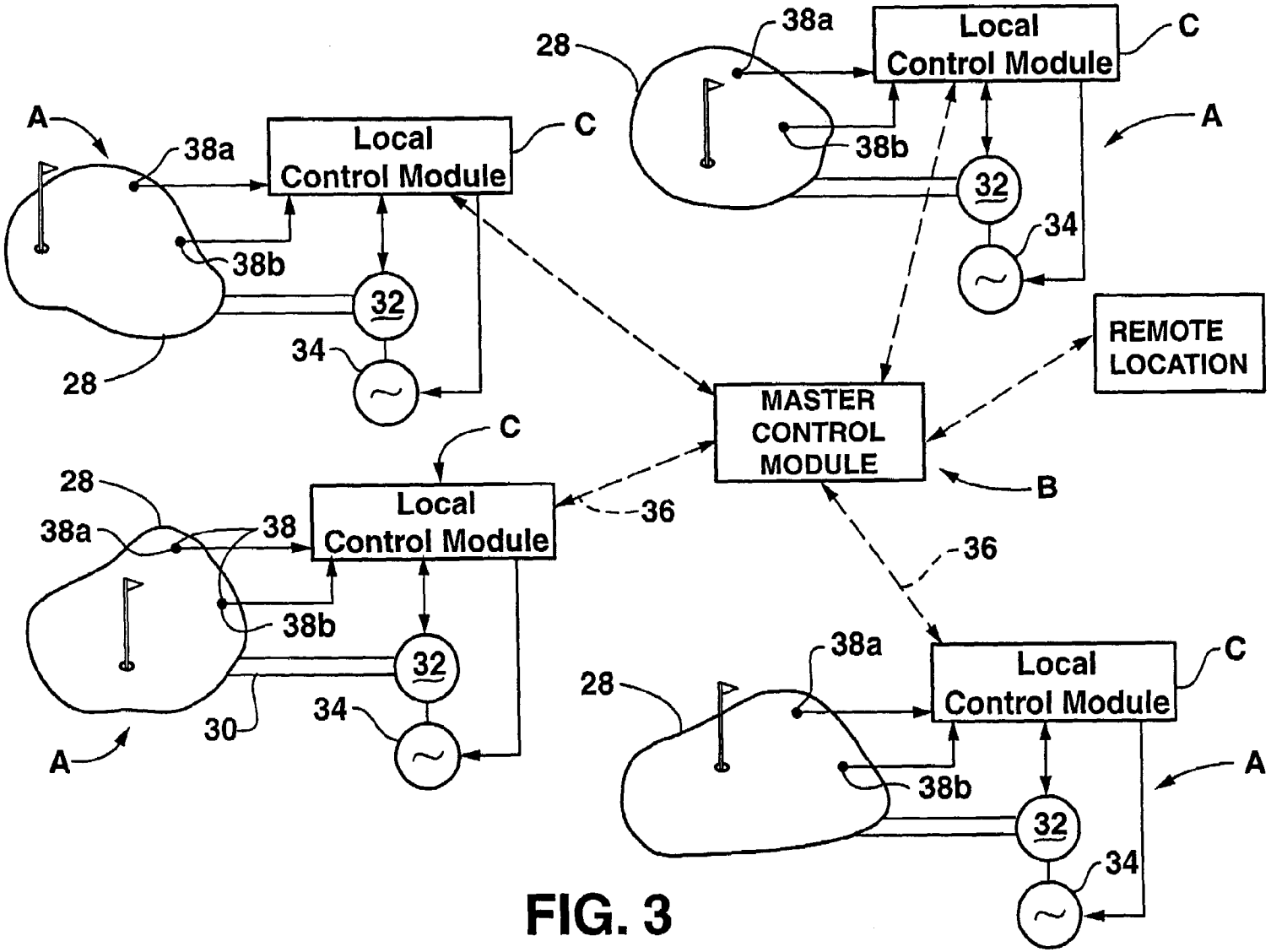
FIG. 3 is a drawing showing a plurality of aeration subsystems, each subsystem dedicated to a specific area of a golf course, and communicating with a programmable master control module, according to principles of the invention.

FIG. 3 is a schematic illustration of a turf conditioning system A having aeration subsystems 27, dedicated to specific areas 28 of a golf course, and communicating with local control modules C. Each aeration subsystem includes a subsurface aeration network having a duct 30, aeration conduits 30*a*, and air blower units 32 in fluid communication with the subsurface aeration network for providing to the specific area of the golf course at least one of air under pressure and a partial vacuum, as has been described hereinabove. A motor 34 is mechanically connected to the air blower unit. As used herein, the term air blower unit any suitable air blower, fan, air pump, etc. configured to establish one of a pressure and a vacuum in the subsurface aeration network with, or without, additional components such as valving, coupling, etc. A suitable blower is available from the Twin City Fan & Blower Company of Minneapolis, Minn. 55442-3238, model 18W8. Local control module (controller) C is operatively coupled to the motor. The local control module is responsive to a directive 36 and to a datum. The aeration subsystem may comprise at least one sensor 38 that measures an environmental parameter. The at least one sensor is in data communication with the local control module. A programmable master control module B receives from the local control modules area information representing a status of the respective specific area to which the local control module is dedicated, and in response to the area information and to a command, the master control module issues directive 36 to the local control module to operate the aeration subsystem.

Local control modules C of the aeration subsystems receive data from sensors 38 provided for the respective areas of interest. The local control modules may be a PLC, and include a communication link accessible by way of a handheld battery-powered device selected from one of a cellular telephone, a personal digital assistant (PDA), and a pocket personal computer (pocket PC). The sensors can monitor environmental parameters such as ambient air temperature, soil temperature, soil moisture, soil salinity, air pressure within a conduit, and solar radiation level, as well as other parameters within an area of interest.

In one configuration, the system comprises eighteen (18) aeration subsystems, each one dedicated to a green of a golf course. However, the system can also be used with other portions of a golf course, such as one or more golf greens, one or more fairways, one or more tee boxes, one or more walkways, one or more gallery viewing areas, one or more driving ranges, one or more putting greens, and one or more practice areas.

Master control module B may be configured to receive area information from local control modules C, and to send directives 36 to the local control modules. The programmable master control module may be a programmable computer, a programmable logic controller (PLC), or a programmable industrial controller. The programmable master control module is programmed with software. The software may be a computer program comprised of one or more computer instructions recorded on a machine-readable medium. When the computer program is executing on the master control module, one or more setpoints are defined for the operation of each aeration subsystem. The master control module can compare a setpoint (or a range of acceptable values defined by a first extremum, such as a low air temperature setpoint, and a second extremum, such as a high air temperature setpoint, to an actual value of an environmental parameter observed by a sensor. A single value setpoint can include a tolerance about the setpoint (e.g. X degrees F., plus or minus 0.5 degrees F.). If the actual value of the environmental parameter is within an acceptable range, the programmable master control module can indicate that fact to a user of the system, for example, by displaying on a display the value in green. Master control module B can determine if an actionable condition exists, for example when one or more actual values of environmental parameters fall outside acceptable ranges. If the actual value is outside of an acceptable range, the master control module can indicate that an actionable condition exists, and the fact that caused the actionable condition to a user of the system, for example, by displaying on a display an out-of-range value in red, by displaying the value with a unique font or a unique visual or audible attribute, by for example by flashing the value or emitting a sound. Optionally, the display also indicates the acceptable range for the out-of-range value. In some embodiments, the programmable master control module displays in a defined manner to a user the values of parameters that are being controlled to bring an out-of-range parameter within an acceptable range, for example displaying a value in yellow while the value is out-of-range and the system is taking action to adjust or correct the value. Similar displays are optionally provided at local control modules when a user is operating the respective local control system directly, and/or at a remote location when a user is communicating with the system from such a remote location.

In some instances, a user of the system interacts with local control module C of a specific area of interest in a local mode. For example, when on site, a greens keeper can operate a local control module to perform a necessary operation of the aeration subsystem dedicated to the area of interest. The greens keeper might want to make specific adjustments, perform maintenance, or otherwise personally oversee an operation of the system at that location.

Figure 4:
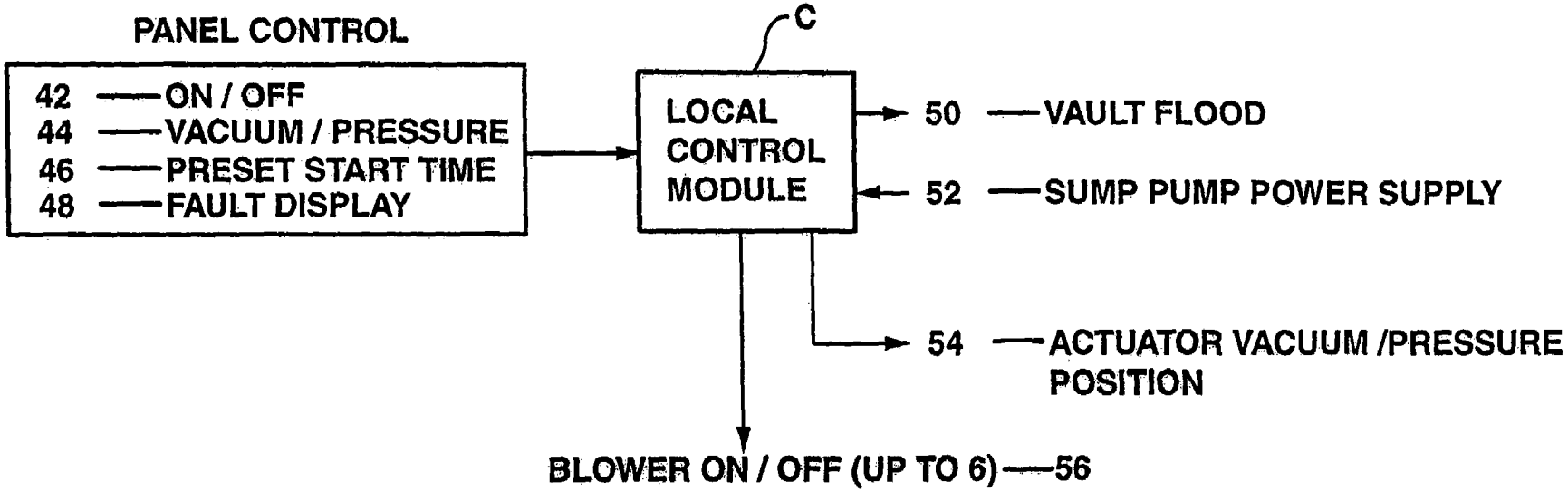
FIGS. 4-7 are drawings depicting exemplary embodiments of a local control module with different features, according to principles of the invention.

FIGS. 4-7 depict examples of local control module C with different features. FIG. 4 shows an embodiment of a local control module C that has a basic complement of features, including the ability to control the on or off state 42 of blower unit 34, the ability to control whether the blower unit operates to provide air pressure or to provide a partial vacuum 44, the ability to define a preset start time 46 for operating the aeration subsystem controlled by the local control module, and the ability to display fault conditions 48. The local control module C also has the ability to sense a flood condition 50 in a vault (e.g., water entering the vault) in which the blower unit and other components are secured, and can provide power 52 to operate a sump pump and/or its associated power supply so as to prevent or counteract the flooding condition. The local control module can send a command 54 to the reversing valve to determine a partial vacuum or air pressure configuration (e.g., actuator vacuum/pressure position). The local control module can send a command 56 to activate or to deactivate the blower unit motor, and in some embodiments, can activate/deactivate any number of blower units. A vault may be located below ground or above ground. With an above ground vault, the controls are located in an enclosure within the vault. For a below ground vault, the controls are located in an enclosure mounted above ground and communication wires connect it to the devices located within the vault.

Figure 5:
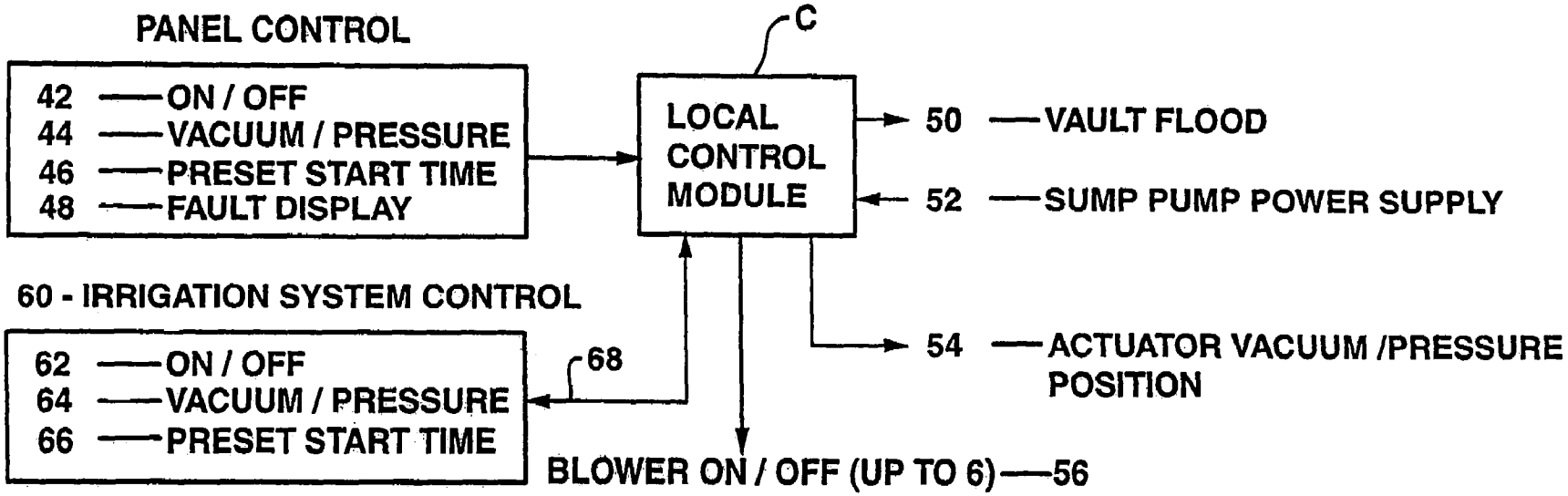

FIG. 5 shows another embodiment of local control module C that has the basic complement of features shown in FIG. 4 and in addition, the optional feature of controlling an irrigation system 60. In some embodiments, the irrigation system can operate according to commands generated by a controller associated with the irrigation system 60 itself, and, using bi-directional communication channel 68, can communicate information such as an on or off state 62, whether it is operating when the aeration system is configured in one of partial vacuum operation or air pressure operation, and commanded to begin operation at an optional preset start time 66. In other embodiments, the irrigation system 60 can be commanded, using bi-directional communication channel 68, to turn on and off 62, commanded to operate when the aeration system is configured in one of partial vacuum operation or air pressure operation 64, and commanded to begin operation at an optional preset start time 66. In some embodiments, the system can include logic to operate the irrigation system 60 to deliberately increase a moisture content of the soil when adding water is appropriate.

Figure 6:
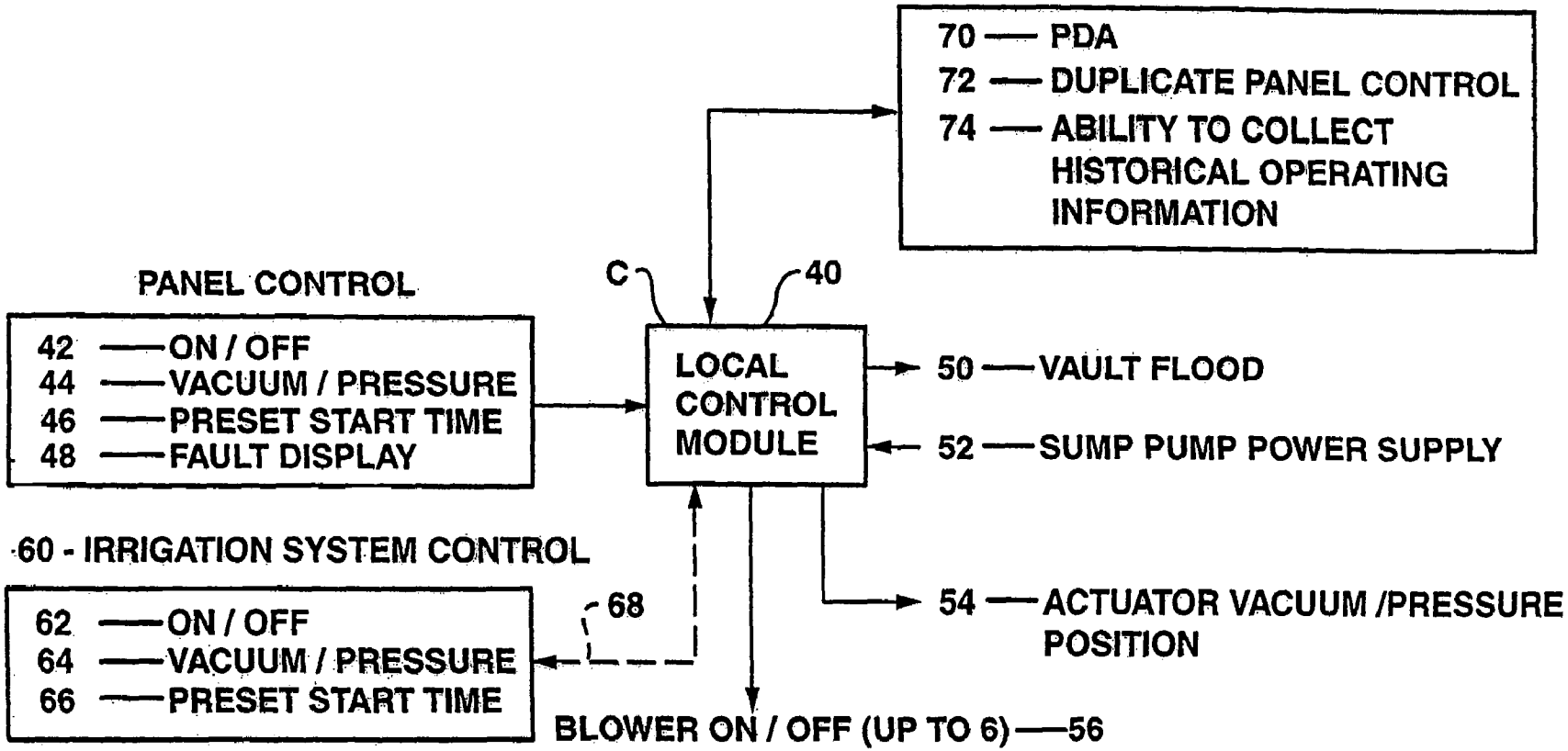

FIG. 6 shows another embodiment of local control module C that has the basic complement of features shown in FIGS. 4 and 5 and, in addition, the feature of using a PDA 70 to duplicate all of the control features 72 of the local control module. The PDA 70 also provides the ability to collect historical operating information 74, for example for statistical data analysis and for trending analysis.

Figure 7:
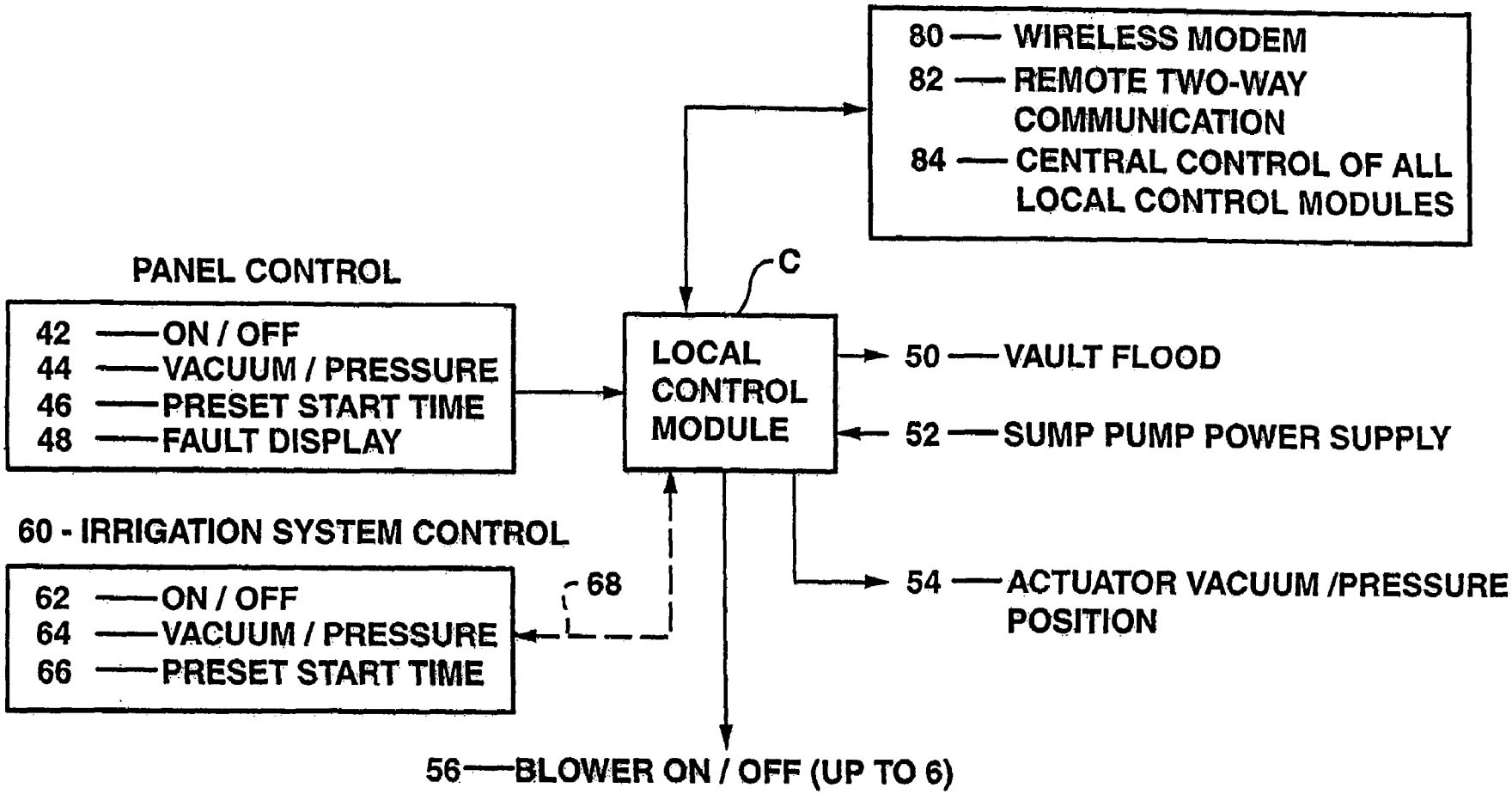
Figure 10:
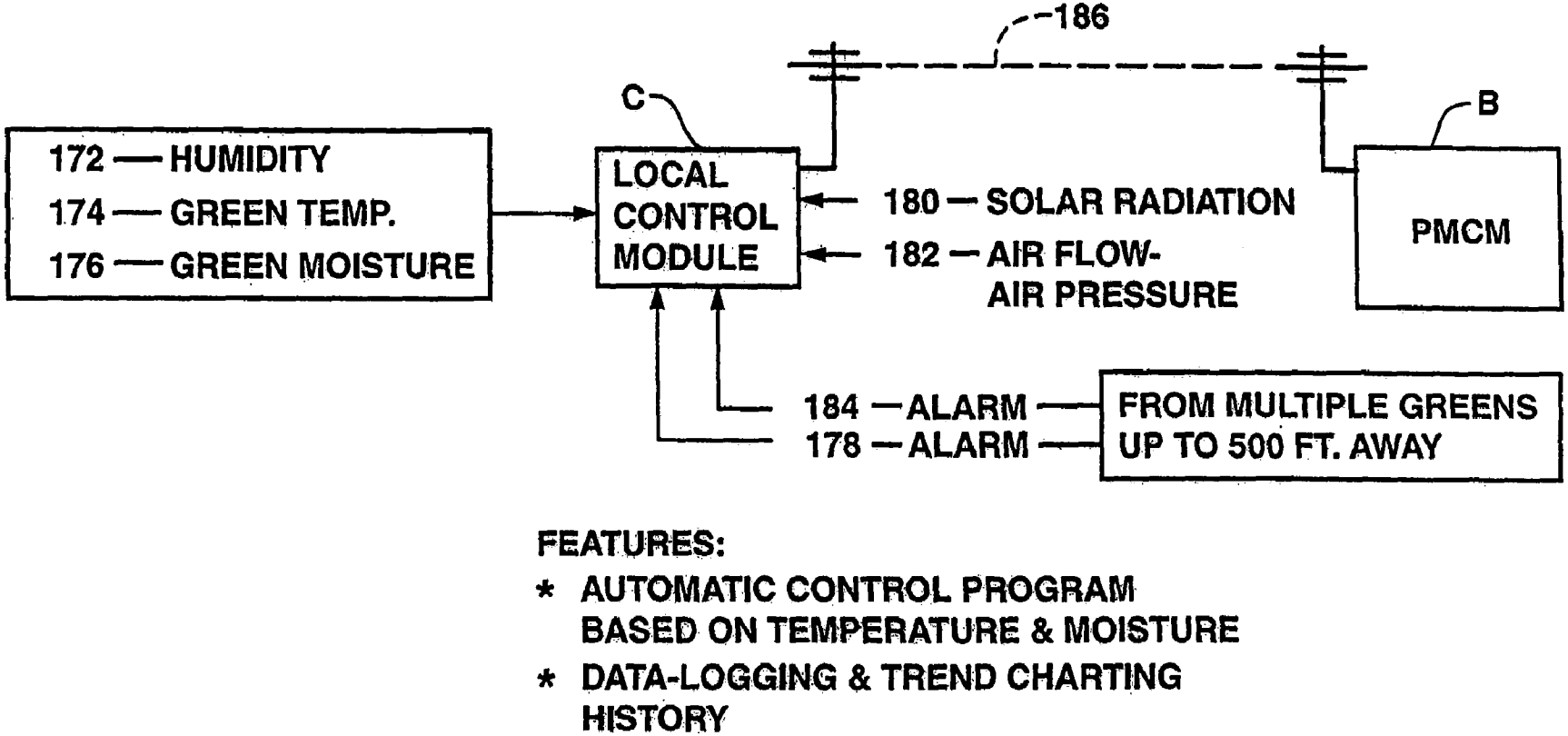
FIG. 10 is a diagram of an illustrative communication configuration including a local control module and a programmable master control module, and showing various environmental sensor signal paths, according to principles of the invention.
Figure 11:
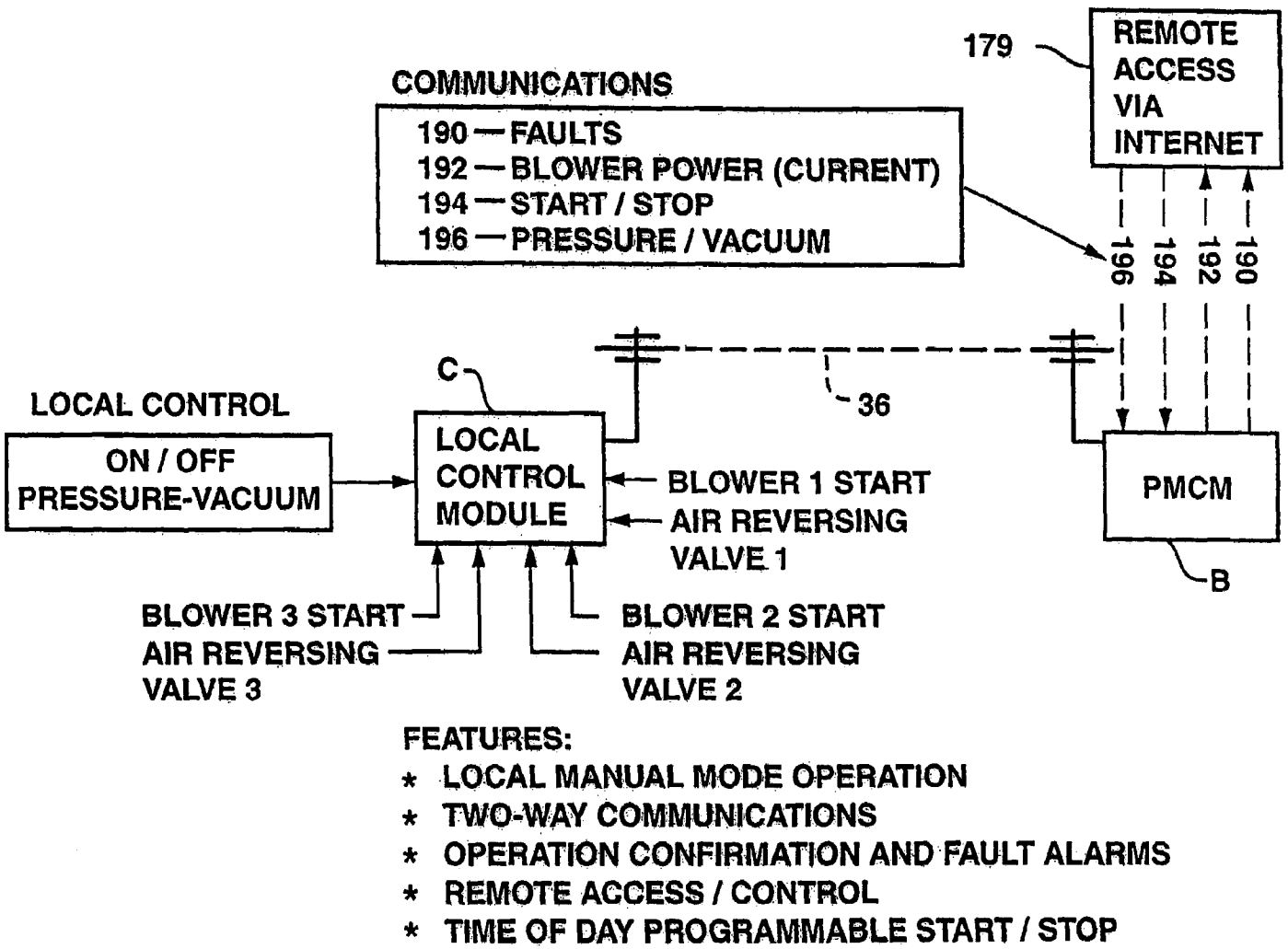
FIG. 11 is a diagram showing an exemplary configuration of communication paths including remote access via the Internet, according to principles of the invention.

FIG. 7 shows a local control module C that has the basic complement of features shown in FIGS. 10 and 11 and, in addition, the feature of using a wireless modem 80 to provide remote two way communication 82 with the local control module C. The wireless modem 80 provides the ability to control all of the local control modules from a central location 84, for example using a personal computer situated in a clubhouse of a golf course.

Figure 8:
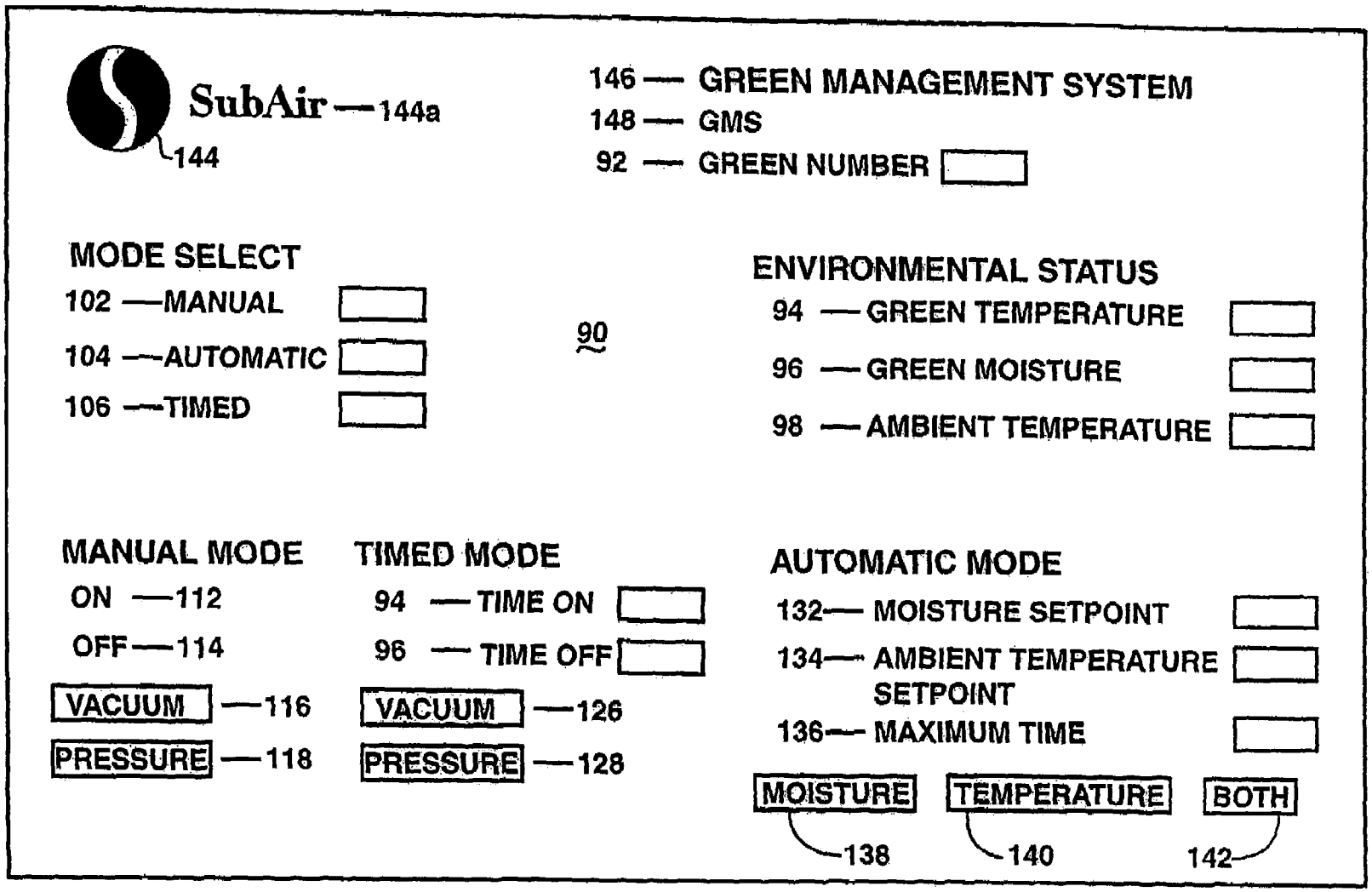
FIG. 8 is a drawing showing an exemplary embodiment of a user display, according to principles of the invention.

FIG. 8 illustrates an exemplary embodiment of a user display 90. In one embodiment, the user display is provided on any or all of a computer monitor, a PDA display screen, and a cellular telephone display screen, and may be a touch screen. In the embodiment of FIG. 8, the display areas presented to a user include the following: an identifier "GREEN NUMBER" and a display box 92 in which a number is displayed; an identifier "ENVIRONMENTAL STATUS" with three data identifiers, namely "green temperature," "green moisture," and "ambient air temperature," followed respectively by regions 94, 96, 98 in each of which a number is displayed, for example temperature in either degrees Fahrenheit or degrees Celsius, and moisture content as a percentage; a "SELECT MODE" identifier, with three possible modes, identified as "manual," automatic," and "timed," followed respectively by regions 102, 104, 106 that can be "buttons" such as are commonly presented to a user of a computer in a graphical user interface ("GUI") such as Microsoft Windows™, or they can be regions that are activated by a key press or mouse click, so that a user is informed which mode is selected for example by illumination, by color change, by highlighting such as flashing, or by any other convenient visual indication; and at the bottom of the display, three regions comprising "buttons" or indicators, one each for "MANUAL MODE," "TIMED MODE," and "AUTOMATIC MODE." In the event that "manual mode" is selected, the user can turn the blower unit on or off, by activating a respective one of indicators 112, 114, and can select provision of partial vacuum or air pressure during operation by activating a respective one of indicators 116, 118. The indicators 112, 114, 116 and 118 can be regions similar to the regions 102, 104 and 106. In the event that the "timed mode" is selected, numerical indications of time (e.g., in a format such as hours, minutes with or without an AM or PM indication) appear in regions 94 and 96, which respectively indicate a time for the controlled blower unit to start, and a time for the controlled blower unit to stop operation, as well as indicators 126 and 128, which as similar to indictors 116 and 118, and which respectively indicate operation with provision of partial vacuum or air pressure. In the event that "automatic mode" is selected, the display indicates a moisture setpoint in region 132, an ambient air temperature setpoint in region 134, and an optional maximum time of operation in region 136. The automatic mode when active deals with moisture and temperature excursions from desired values, and can indicate, by activating indicators 138, 140, and 142, whether the automatic system is operating to deal with an excursion in moisture content, an excursion in temperature, or excursions in both parameters, by activating a respective one of indicators 138, 140 and 142. Excursions in soil temperature values may also be used for more effective control.

Figure 9:
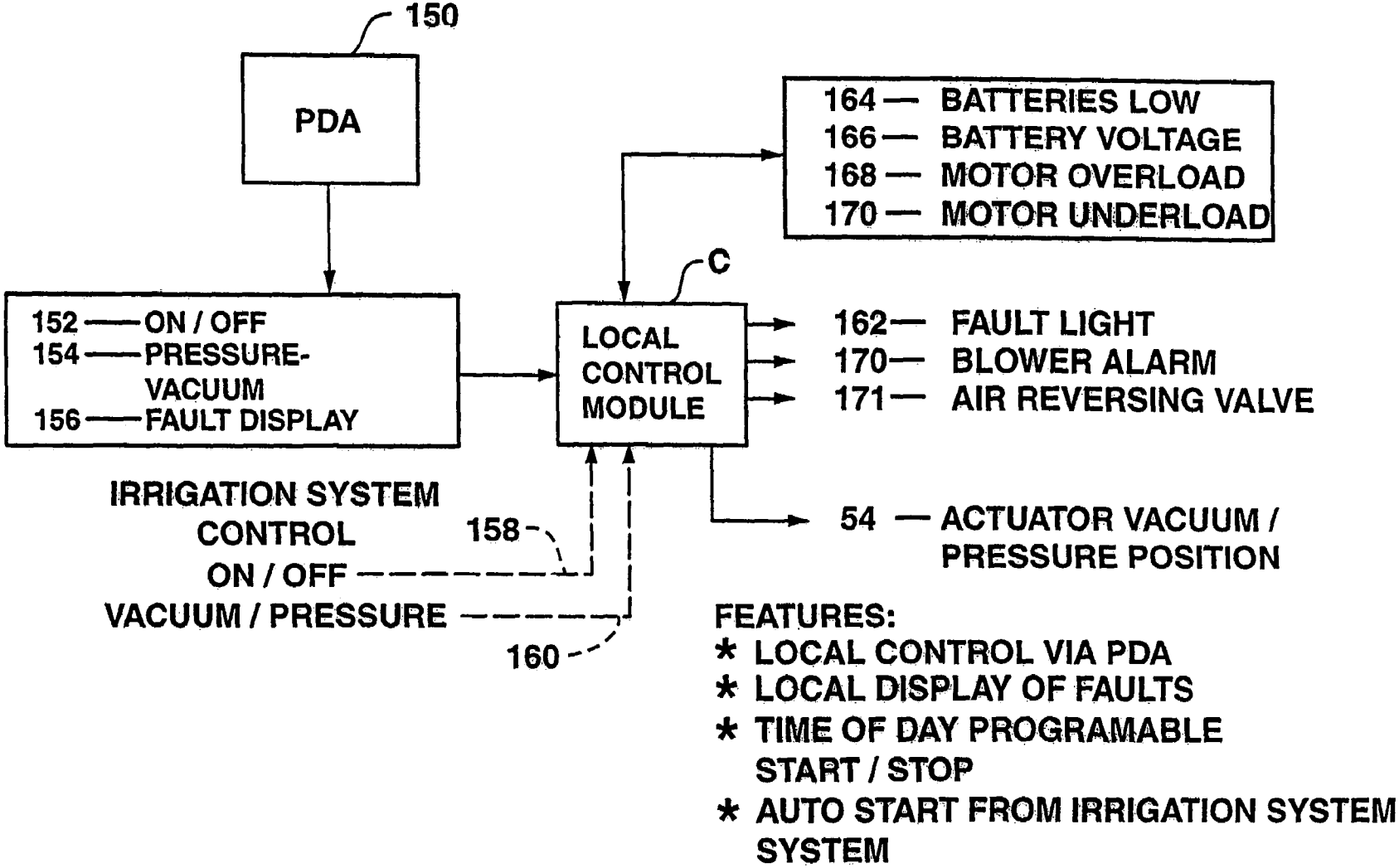
FIG. 9 is a diagram of an exemplary local control module, showing various control signal paths, according to principles of the invention.

FIG. 9 is a diagram of an exemplary local control module C, showing various control signal paths. Local control module C receives signals from a PDA 150 module indicating the on/off condition 152 of a blower unit, the air pressure/partial vacuum configuration 154 of a reversing valve, and a timer on/off time 156. The local control module may receive information about the condition 158 of an optional irrigation system, including whether the irrigation system is on or off, and whether the irrigation system is configured to operate when the reversing valve is configured to provide air pressure or partial vacuum 160. Local control module C provides signals indicating the presence of a fault 162, for example by illuminating a fault light, which can indicate any of the conditions of low batteries 164 (optional), a problem in the vault 166 such as flooding, a motor overload 168, and a motor underload 170. A signal 170 is provided to indicate that the blower unit is starting (or is operating), and a signal 171 is provided to indicate the configuration of the reversing valve (e.g., providing air pressure or partial vacuum). The reversing valve can be replaced by a universal coupling that permits the drainage system to be selectively coupled to either the discharge or the suction port of the air pump. This combined with the use of a mobile unit, provides for an economically feasible system for treating multiple greens that have appropriate drainage systems, and it may be used with above ground stationary systems as well.

FIG. 10 is a diagram of an illustrative communication configuration including local control module (LCM) C, programmable master control module (PMCM) B, and showing various environmental sensor signal paths. In FIG. 10, the local control module receives a variety of environmental signals from sensors, including humidity 172, green (soil) temperature 174, green (soil) moisture 176, ambient temperature 178, solar radiation level 180, air flow/air pressure 182 in a conduit and other signals 184. The data collected by local control module C is communicated, in one embodiment, by wireless communication link 186 to master control module B FIG. 11 is a diagram showing an exemplary configuration of communication paths including remote access via the Internet. In the embodiment shown in FIG. 11, local control module C communicates by radio modem with programmable master control module B, which in turn is (optionally) in communication with a remote access site connected by way of the Internet 179. Local control module receives signals S from a sensor that monitors the current provided to the blower unit. The local control module, in the embodiment of FIG. 11, controls three aeration subsystems, and can issue commands C1, C2, C3 to turn motors on and off, and to control a configuration of a reversing valve. The local control module sends information to programmable master control module B, and receives directives from the programmable master control module. In turn, the programmable master control module communicates fault conditions 190, status information such as motor-blower power and/or current 192 and the like to remote access site 179 which is manned by a user. The information sent to the remote access site, which may be a personal computer, can be any information that would be displayed to a user on the display screen 90, as well as other information useful for statistical analysis and trending analysis. The user at the remote access site 179 can issue commands including, for example, start and stop commands 194 for a blower unit, and configuration commands 196 to configure a reversing valve to provide a selected one of air under pressure or a partial vacuum. Programmable master control module B in turn issues directives 36 to local control module C, by which directives the local control module is instructed to carry out the commands of the user operating the remote access site 179.

FIG. 12 is an enumeration of some of the components, communication and control channels, and logic structure of one or more embodiments of the golf course environmental management system. The components enumerated include an equipment panel and various field devices. The equipment panel is one example of the local control module described hereinabove. The field devices include a high pressure air pump, an air reversing valve and actuator, a sump pump, a float switch, a moisture/soil temperature sensor, and an ambient air temperature sensor, as well as associated operational equipment such as a local electrical disconnect, a transformer, a motor contactor, a current switch, a motor overload indicator, relays for various purposes, such as starting the motor and operating the actuator for the air reversing valve, a panel door switch and a fault light on the panel door. Some of the field devices are optional in some embodiments. FIG. 12 describes in overview some of the communication and control lines that are provided in some embodiments, and the signals that pass along the communication and control lines. In one embodiment, the description of the communication and control refers to control signals and status signals that are communicated to and from the programmable master control module described hereinabove. The logic requirements, such as air pump on based on time of day, or air pump on based on temperature and or moisture, can be implemented by local control module itself, or by the programmable master control module (or by a user of the system) and communicated as a directive to the local control module.

Intermittent Mode of Operation

A particular advantageous form of automatic mode operation, according to the present invention, is to operate the system and method continuously but operate in cycles of intermittent operation. The intermittent mode of operation includes continuously repeating cycles wherein the blower unit is turned on for a short interval and turned off for a long interval during each cycle. The level of carbon dioxide decreases significantly after the short interval and retains much of this decrease even during the long interval. At the same time the level of oxygen in the turf increases. The intermittent mode of operation achieves the full benefits of using subsurface aeration from both a moisture removal and agronomic standpoint. In this manner, approximately 50% of the air in the soil profile can be exchanged from a short duration treatment and remain at favorable levels for several hours afterward. By providing this intermittent mode continuously, except for certain manual and programmed overrides, healthy turf at low energy costs can be had. A 5 minute treatment every 2 hours has been found as a preferred cycle of intermittent operation. This duration results in one hour of operation per day per unit. However, to save energy the intermittent mode may be adjusted based on seasonality. So for a golf course with a cool season grass like Bentgrass on its greens, the frequency could be adjusted to 5 minutes per hour during the stressful summer months, 5 minutes every 2 to 3 hours during spring and fall, and 5 minutes every 3 to 4 hours in winter. Although running for just a short duration the aeration subsystem will still draw excess water from the profile.

Intermittent mode operation can be optimized by adding an ambient temperature sensor 38*a* (FIG. 13) and selecting the direction of air flow through the green 28 based on ambient temperature. This provides the added benefit of temperature moderation in addition to removing excess water and exchanging gases in the profile. Temperature optimization can be accomplished because a blower unit may be used either in a vacuum or pressure mode. Setpoint values are programmed or set in control module C. Moving air in pressure mode will condition the air since ambient air is moved through drainage pipes, a gravel layer and the lower portion of the soil profile that are located at a depth where the temperature is a fairly consistent 55° F. The short duration run time will not impact the temperature at this level due to the mass of this infrastructure. For a cool season grass like Bentgrass the intermittent mode is set to turn on in vacuum mode at temperatures generally above a first air setpoint and less than a second air setpoint. At temperatures generally above the second air setpoint the unit will turn on in pressure mode and the turf benefits from the cooling effect. At temperatures below the second air setpoint, the unit does not operate since the turf is experiencing little growth. The intermittent cycle is different for a warm season grass like Bermuda grass. The unit will be turned on in pressure mode above the second air setpoint vacuum mode between the first and second air setpoints. In the last instance, the turf benefits from heating since the conditioned air is warmer than the ambient temperature. As with cool season grasses the unit will not operate intermittently below the first air setpoint since the turf in this case is now dormant. In all cases the golf course has the option of turning the unit on and running it in either pressure or vacuum mode for any desired duration. The intermittent mode of operation will resume after the desired length of treatment has been completed. The intermittent mode of operation allows golf courses and sports fields to optimize turf growing conditions by controlling air-water ratios in the soil profile.

Figure 14:
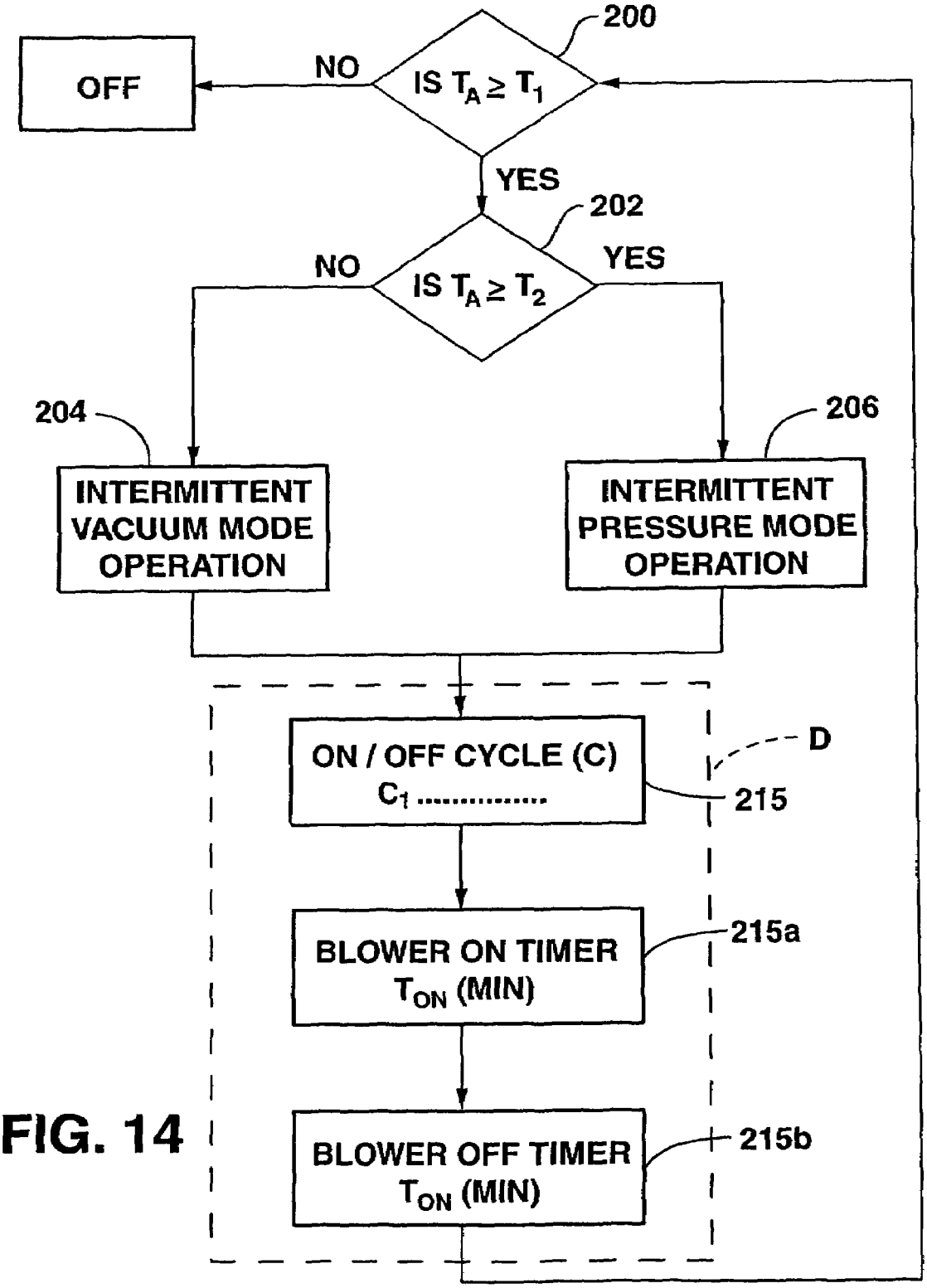
FIG. 14 is a flowchart illustrating the intermittent mode of operation for a cool season grass based on ambient air temperature as a sensed variable.

Referring now to the drawings, the intermittent operation of the system will now be described as controlled by control module C. Referring to FIG. 14, the intermittent routine for a cool season grass is illustrated. For example, Bentgrass is a cool season grass which is popular for putting greens. Cool season grass needs to be conditioned and cooled in the summertime in the south and southeast as much as possible. With the system turned on, the intermittent operation is initiated at 200 if the ambient air temperature ($T_A$) is generally greater than a first air setpoint ($T_1$). "Generally greater" is used to mean generally greater than or equal to, and/or that range around the setpoint that is effective for the process being carried out. The first air setpoint is a low temperature below which operation of the system is not effective to promote agronomics of the turf, and below which the system is off. If the ambient temperature is generally greater than the first setpoint and is generally less than a second air setpoint ($T_2$) at 202, the system is placed in the intermittent vacuum mode at 204 and ambient air is drawn downwardly through the soil profile. If the ambient temperature is generally greater than the second air setpoint, the system is placed in the intermittent pressure mode of operation at 206 wherein air is drawn through conduits embedded in the ground so that the air is cooled and forced upwardly through the subprofile to condition the turf. In either mode of operation, intermittent operation is the same as shown at D. A first on-off cycle (C) is initiated wherein the blower is on for a short time period ($T_{on}$), e.g. five minutes. After five minutes the blower off mode ($T_{off}$) begins for a longer off time period, e.g. 115 minutes. This concludes the first intermittent cycle of two hours and the next intermittent cycle begins as long as the ambient temperature is above the first air setpoint $T_1$.

Figure 15:
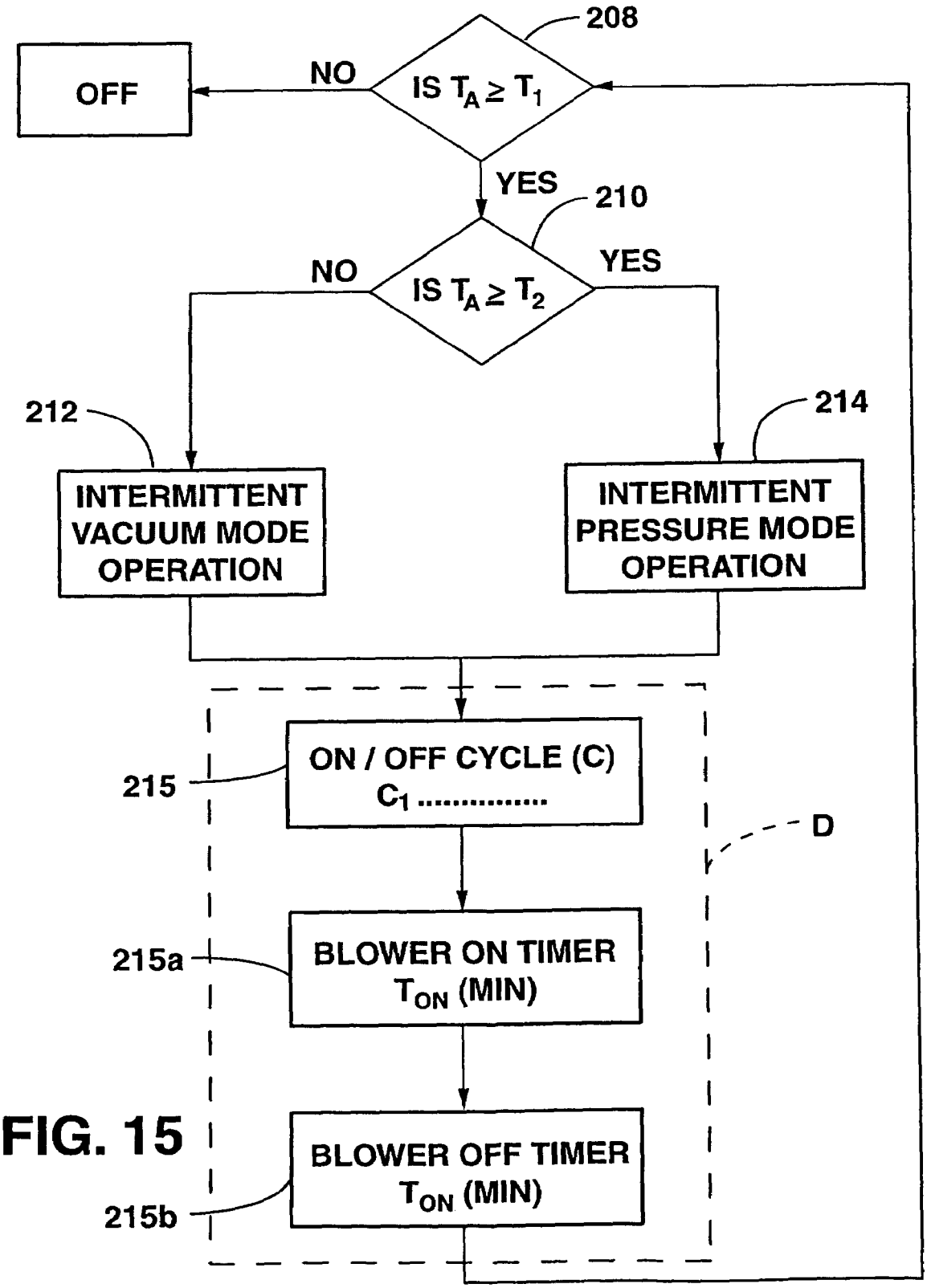
FIG. 15 is a flowchart illustrating the intermittent mode of operation for a warm season grass based on ambient air temperature as a sensed variable.

Referring now to FIG. 15, the operation of the turf conditioning system will now be described in reference to a warm season grass, such as Bermuda grass and the like. When the system is turned on, intermittent operation is initiated when the ambient air temperature is generally greater than a first air setpoint ($T_1$) at 208. Next, the ambient air temperature is measured against a second air setpoint ($T_2$) at 210 to determine whether intermittent vacuum or pressure mode operation is needed. If the ambient air temperature is generally greater than the first air setpoint and less than the second air setpoint, then the intermittent vacuum mode at 212. If the ambient air is generally greater than the second air setpoint, the intermittent pressure mode is initiated at 214. Again, in either intermittent vacuum or pressure mode, the intermittent operation D is the same, as illustrated in FIG. 14. First, an intermittent on/off cycle C is initiated at 215. This cycle includes turning the blower on for a period of $T_{on}$ at 215*a*, and turning the blower off for a period of $T_{off}$ at 215*b*. Again, for example, the blower may be turned on for 5 minutes and the blower will be turned off for 115 minutes for a 2 hour cycle. A next cycle begins as long as the ambient air is generally greater than the first air setpoint at 208, or a manual or environmental condition override occurs.

Figure 16:
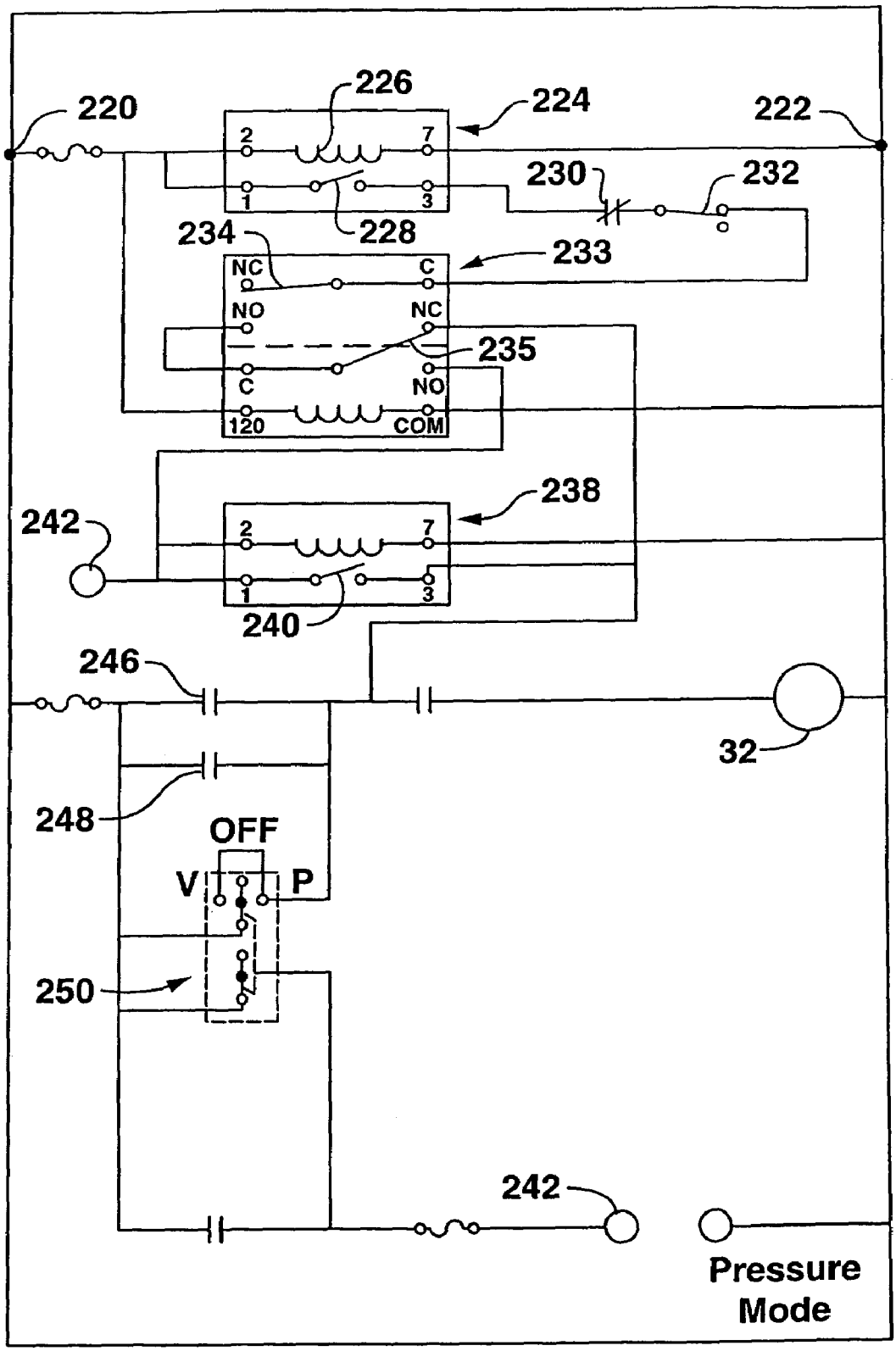
FIG. 16 is a schematic diagram of a simplified intermittent control circuit for controlling intermittent operation in one of a vacuum and pressure mode at one or more golf course areas according to the invention, particularly where a central master control module is not used.

Referring now to FIG. 16, a simplified automatic control circuit E for control module C to control intermittent operation of the blower responsive to ambient air temperatures is schematically illustrated according to the invention. Control circuit E is particularly suitable for managing turf conditions on one or more areas where a central, master control module is not employed to receive information and control the areas remotely. In this case, control circuit E is provided at each area and the groundskeeper sets the setpoints of the circuit at each area. In operation, power across terminals 220 and 222 is applied to an intermittent timer circuit 224 connected between the terminals. The power across a timer coil 226 causes a timer switch 228 to close turning the intermittent mode of operation on. The timer circuit may be set, for example, for a two hour cycle including a five minute interval for a blower-on mode and a 115 minute interval for the blower-off mode. The blower unit can be programmed to operate more frequently based on environmental parameters. For example, for a cool season grass with high ambient and surface temperature the unit can be programmed to operate for 5 minutes every hour as opposed to every 2 hours. As the ambient and soil temperatures drop the unit will operate every 2, 3 or 4 hours depending on the temperatures. In other words, the frequency of operation need not be fixed but can vary based on ambient and soil temperature thus lowering operating costs. The times may be manually set in the times circuit or the times may be input electronically. Any suitable timer may be utilized such as OMRON H3CR unit available from Omron Electronics Pte Ltd. of Singapore. When the timer switch is closed, power goes through a first relay switch 230 and a key switch 232 to a contact of a thermal switch circuit having a two stage thermal switch or relay (thermostat) with a normally closed thermostat switch 234 and a normally closed thermostat switch 235. The key switch turns the system off and on. The thermal relay is set so that if the temperature is below the first air setpoint, stage 1, normally closed thermostat switch 234 is closed, and no power is delivered to the blower unit. However if the ambient temperature is above the first air setpoint, then stage 1 thermostat switch 284 is open, moving to the "NO" contact, so that power is delivered to normally closed switch 235. Switch 235 is closed when the ambient temperature is generally less than the stage 2 thermostat, i.e. the second air setpoint. If the ambient temperature is generally below the second air setpoint, the intermittent vacuum mode is initiated by power being applied directly to the blow unit 32. If the ambient temperature is above the second air setpoint, the normally closed switch 235 moves to the normally open (NO) position where power is delivered to a time delay relay circuit 238 across contacts 2 and 7. The air temperature setpoints S1 and S2 may be manually set in the thermal switch or may be input electronically. A suitable thermo switch is a RANCO dual stage thermostat ETC 211000 available from Metropac of Foxboro, Me. When power is delivered to delay circuit 233, delay switch 240 is closed to deliver power to a diverter valve 242 which controls a mechanism that reverses the flow of air through the blower unit to establish the pressure mode in the aeration conduit of the aeration subsystem. The time delay is set for a sufficient time, e.g. 2 minutes, to allow the blower unit to be reconfigured for the pressure mode before the blower unit is turned on. After 2 minutes, delay switch 240 opens whereupon power is delivered to the blower unit 32. The time delay circuit 233 may be any suitable device or relay such as a Dayton 5 X 83ON time delay relay available from Dayton Electronics of Chicago, Ill. A suitable key relay 230 may be used such as a Telemecanique key switch ZBE-102 available from R.S. Components Pte Ltd. of Singapore. Also included in the control circuit is a pair of irrigation system relays 246 and 248. When the irrigation system is turned on, the irrigation relays act to disable the intermittent mode operation. In addition, a manual switch circuit is illustrated at 250 by which continuous vacuum (V) or pressure (P) mode operation can be selected which likewise overrides the intermittent operation. In addition, relay 230 provides an automatic override of the control circuit if a prescribed environmental or operation condition is detected.

Example of Intermittent Mode Air Setpoints for Cool and Warm Season Grass

The following is an example of first and second air setpoints for controlling the intermittent mode of operation between the vacuum and pressure modes.

Cool Season Grass

| | Air Temperature | | |
|---|---|---|---|
| | Below 55 | Between 55–80 | Above 80 |
| Mode of Operation | Off | V | P |

Warm Season Grass

| | Air Temperature | | |
|---|---|---|---|
| | Below 55 | Between 55–80 | Above 80 |
| Mode of Operation | Off | V | P |

Figure 13:
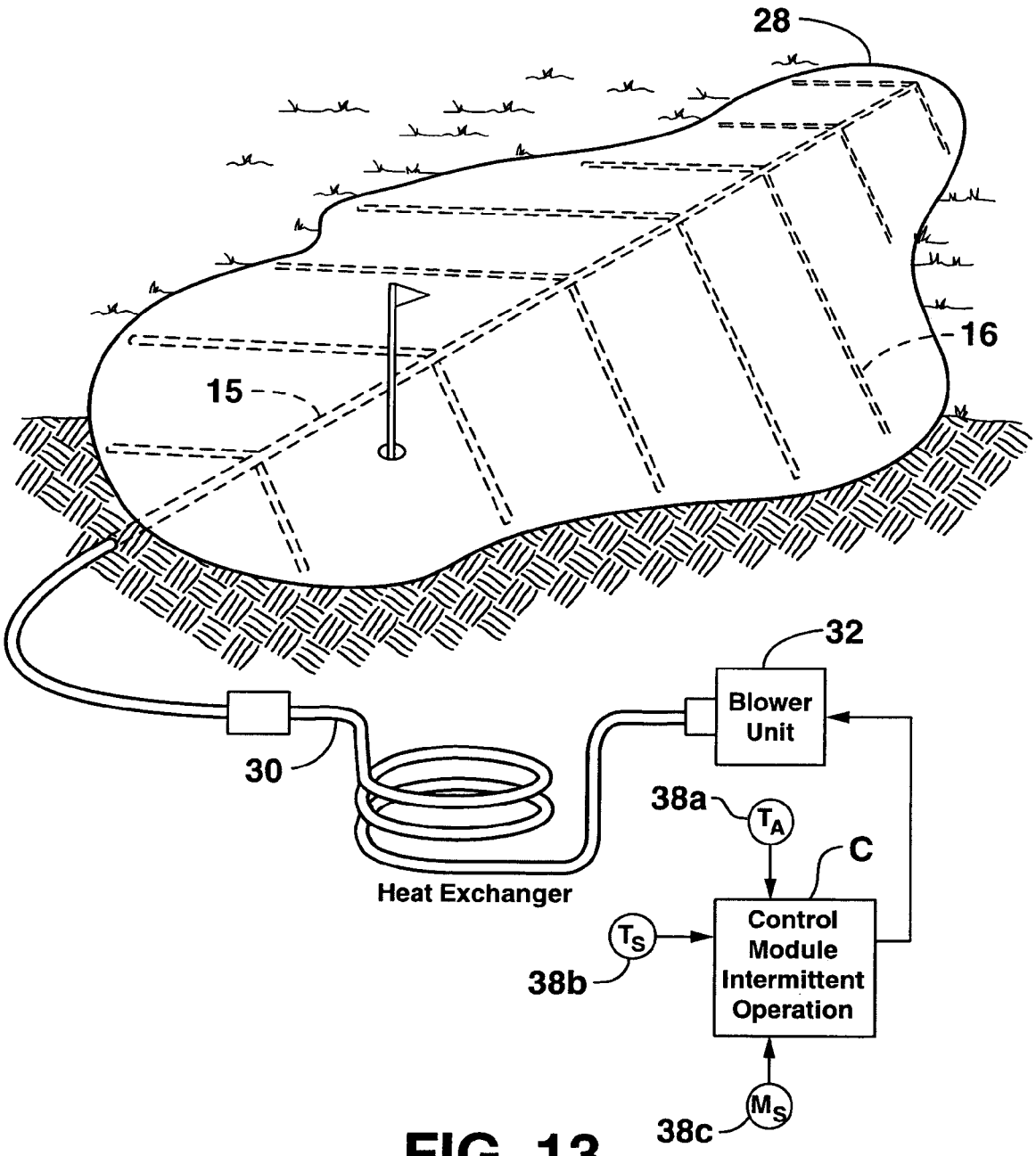
FIG. 13 is a schematic view illustrating a single golf course area for purposes of describing a simplified, intermittent control system and method according to the invention wherein the subsurface aeration system or systems operating in cycles of intermittent operation in one of a vacuum or pressure mode.
Figure 17:
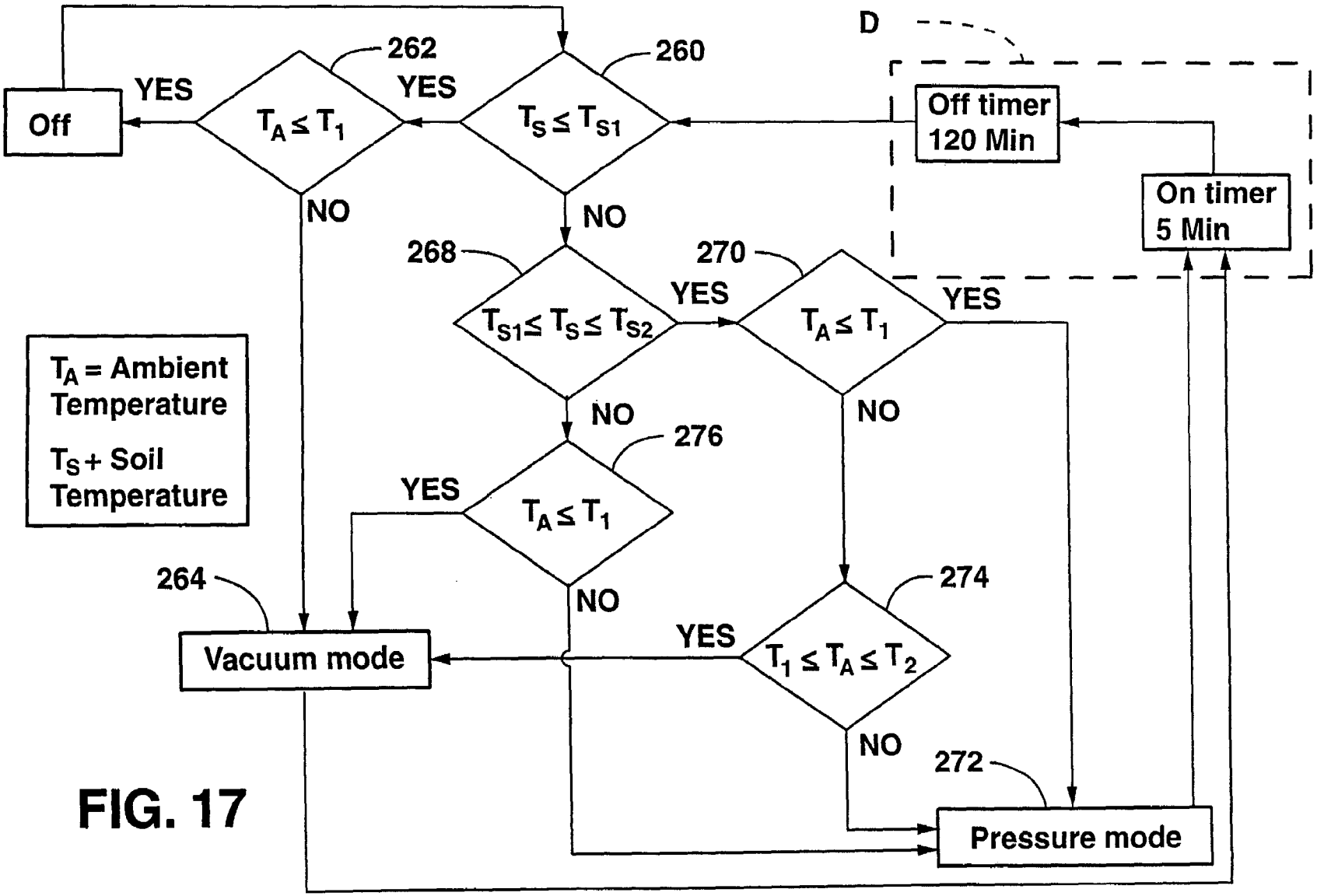
FIG. 17 is a flowchart illustrating the intermittent mode of operation for a cool season grass based on ambient air temperature and soil temperature as sensed variables.

Referring to FIG. 17, a flow chart will be described illustrating the intermittent operation of the system and method based on the variables of ambient air temperature and soil temperature ($T_s$) for a cool season grass. In this case, a soil temperature sensor 38*c* is provided at golf course area 28 in addition to air temperature sensor 38*a* (FIG. 13). As a prerequisite intermittent mode to operate, the soil temperature must be generally greater than a first soil setpoint ($T_{s1}$) and the ambient air must be greater than a first air setpoint ($T_1$), as determined at 260 and 262. If these conditions are not positive then intermittent mode remains off. If it is determined at 262 that the air temperature is generally greater than the first air setpoint then the intermittent vacuum mode is selected at 264 turning on the cycles of intermittent operation at D. The cycles of intermittent operation continue as long as the above described air and soil temperature condition exist at 260, 262 which are evaluated after each cycle. If the soil temperature is determined to be generally greater than the first soil setpoint at 260, then it is determined whether the soil temperature is also generally less than a second soil setpoint ($T_{s2}$) at 268. If the determination is positive, the air temperature is compared to the first air setpoint at 270. If the air temperature is generally less than the first air setpoint, then the pressure mode is selected at 272 and intermittent operation in the pressure mode begins at D and continues as long as the air and soil temperatures for that mode are satisfied. In the event that the air temperature is generally greater than the first air setpoint, then the air temperature is compared to a second air temperature setpoint ($T_2$) at 274. If the air temperature is generally between the first and second air setpoints, then the vacuum mode is selected at 264 and the intermittent mode operation is initiated at D and continues as long as the temperature and soil conditions are satisfied for that mode. If the comparison at 274 determines that the air temperature is greater than both air setpoints, then the pressure mode is selected at 272 and the intermittent operation is initiated at, which continues as long as those conditions are met. If the comparison at 268 determines that the soil temperature is greater than both soil setpoints, a determination is made at 276 as to whether the ambient air temperature is generally less than the first air setpoint. If so, the vacuum mode is initiated at 264 and intermittent operation is initiated at and continues as long as those conditions are met. If the comparison at 276 shows that the air temperature is not generally less than the first air setpoint, then the pressure mode is initiated at 272 and the intermittent operation is initiated and continues as long as those conditions are met.

Figure 18:
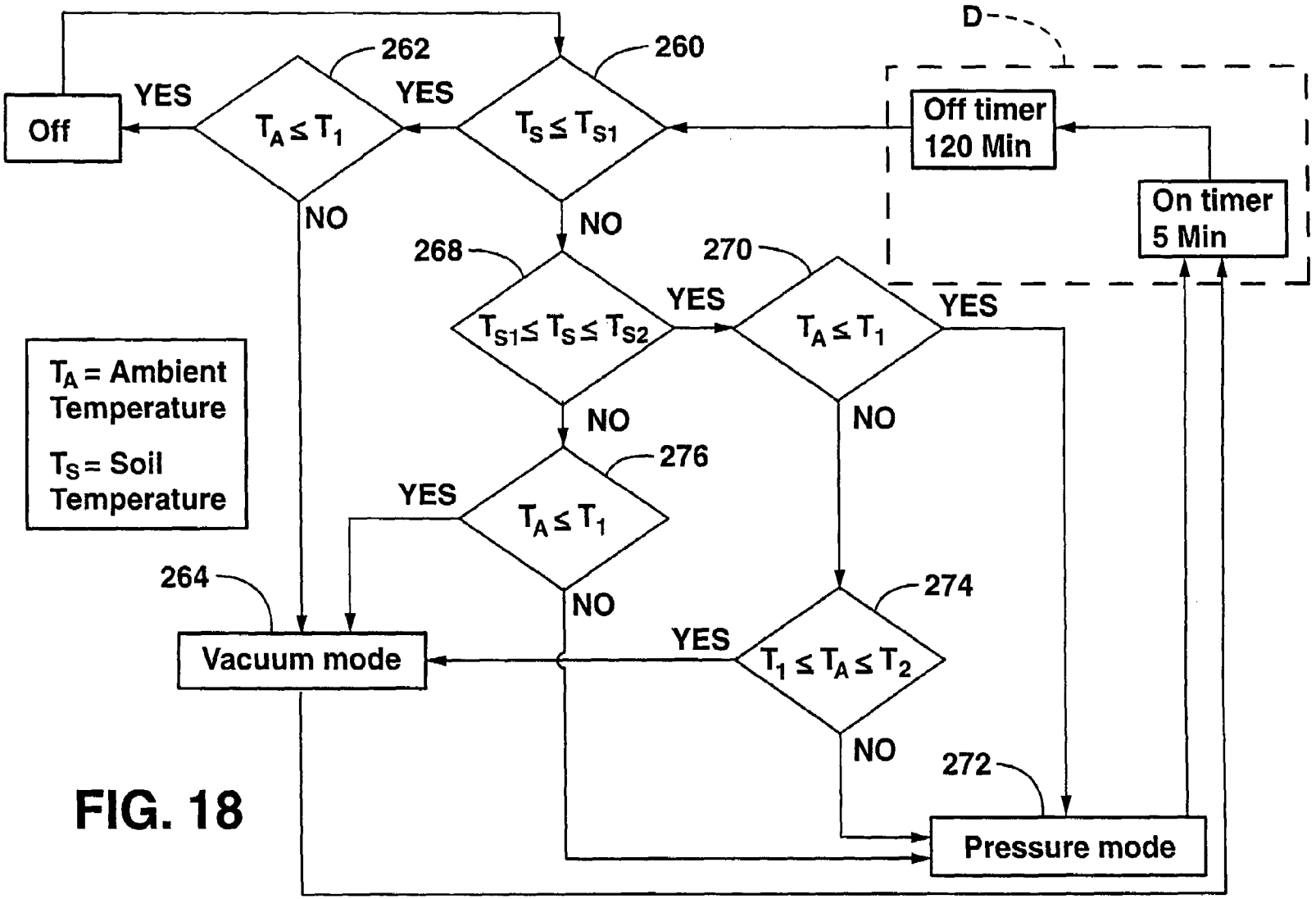
FIG. 18 is a flowchart illustrating the intermittent mode of operation for a warm season grass based on ambient air temperature and soil temperature as sensed variables.

Referring to FIG. 18, a flow chart for the intermittent mode of operation based on ambient air temperature and soil temperature is illustrated for a warm season grass. This flow chart operates with the same logic as described above in reference to FIG. 17 for the cool season grass, except that the second air setpoint and second soil setpoint are selected to be about 15° F. higher than the second air and soil setpoints for the cool season grass. For example, the second air and soil setpoints for the cool season grass may be 80° F., and the second air and soil setpoints for the warm season grass may be 95° F. Otherwise, the operation of the intermittent mode is the same for both cool and warm season grass as described above and the explanation will not be repeated herein.

Example of Intermittent Mode Air and Soil Setpoints for Cool and Warm Season Grass The following is an example of first and second air setpoints and first and second soil setpoints for controlling the intermittent mode of operation between the vacuum and pressure modes.

Cool Season Grass

| | Soil Temperature | | | | | | | | |
|---|---|---|---|---|---|---|---|---|---|
| | Below 55 | | | 55–80 | | | Above 80 | | |
| | Air Temperature | | | | | | | | |
| | Below 55 | 55–80 | Above 80 | Below 55 | 55–80 | Above 80 | Below 55 | 55–80 | Above 80 |
| Intermittent Mode | Off | V | V | P | V | P | V | P | P |

Warm Season Grass

| | Soil Temperature | | | | | | | | |
|---|---|---|---|---|---|---|---|---|---|
| | Below 55 | | | 55–95 | | | Above 95 | | |
| | Air Temperature | | | | | | | | |
| | Below 55 | 55–95 | Above 95 | Below 55 | 55–95 | Above 95 | Below 55 | 55–95 | Above 95 |
| Intermittent Mode | Off | V | V | P | V | P | V | V | P |

Figure 19:
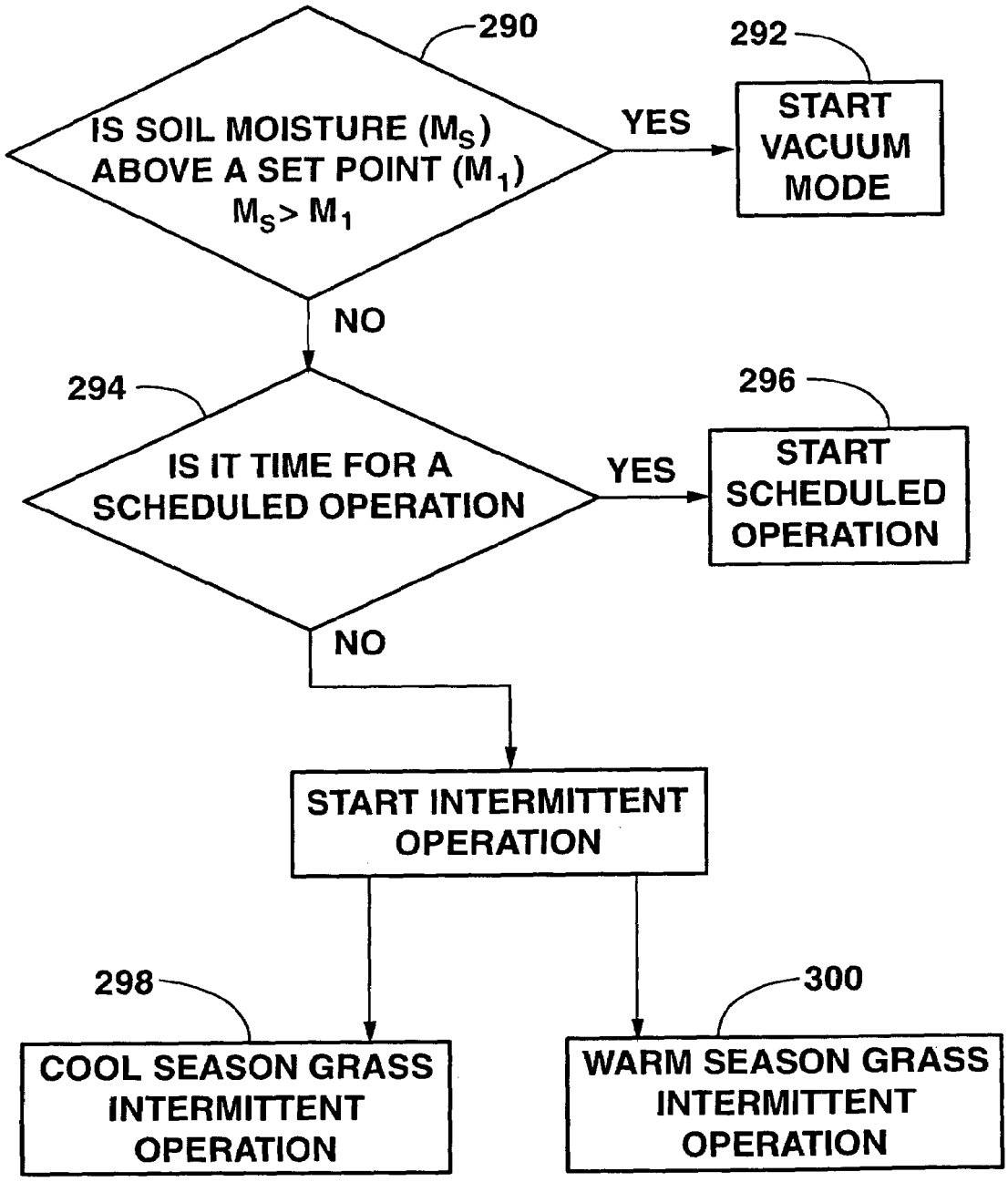
FIG. 19 is a flowchart illustrating a control for overriding the intermittent mode of operation bases on one of an environmental condition and a manual or scheduled operation.

FIG. 19 illustrates an example of a turf conditioning and oxygenating system in accordance with the present invention wherein excess water removal operation and a scheduled operation are automated along with the intermittent operations, as described above. In this routine, before intermittent operation is begun, a determination is made at 290 to see if excess moisture is contained in the soil profile. For this purpose, a soil moisture sensor 38*c* (FIG. 13) is utilized to provide information of the soil moisture content ($M_s$). If the soil moisture is above a moisture setpoint, $M_1$, which indicates an excess water condition, the vacuum mode operation is begun at 292. In this case, the blower unit is run continuously until the soil moisture is reduced below the moisture setpoint, and the system is not run in the intermittent mode during that time. Next, if the soil moisture is below the moisture setpoint, then the controller looks to see if it is time for a scheduled operation at 294 such as water irregation. If it is time for a scheduled operation, then the scheduled operation begins at 296. If it is not time for a scheduled operation, then the system enters either the cool season grass mode or warm season grass mode for intermittent operation at 298 and 300.

In another aspect of the invention, a computerized method is provided for conditioning and oxygenating turf at an area of interest within a golf course comprising the steps of providing an aeration subsystem at the golf course area which includes a perforated aeration conduit disposed below the turf, and a blower unit in fluid communication with the aeration conduit configured to establish one of a vacuum in a vacuum mode and air under pressure in a pressure mode in the aeration conduit. A control module controls operation of the aeration subsystem. The method includes determining whether a condition exists for conditioning and oxygenating the soil at the area in response to the ambient air temperature. If the condition exists, the method operates the aeration subsystem to create one of a vacuum mode and a pressure mode in the aeration conduit for one of reducing or increasing a temperature of turf at the area. The method operates the blower units in repetitive cycles of intermittent operation during the one of the vacuum mode and pressure mode wherein each cycle includes a blower-on mode and a blower-off mode. In the blower-on mode, the method operates the blower units for a first time interval, and in the blower-off mode discontinues operation of the blower units for a second time interval during each repetitive cycle. The method terminates the intermittent operation of the aeration subsystem in response to detecting one of a predetermined environmental condition and operational condition. The environmental condition includes one or more of soil moisture, ambient air temperature, and soil temperature. The method includes overriding the cycles of intermittent operation of the aeration subsystem as selected by an attendant or scheduled event.

The method includes a first air setpoint and a second air setpoint programmed in the control module. The method initiates the intermittent operation of the aeration subsystem when the ambient temperature is generally greater than the first air setpoint. The method initiates the intermittent operation in the vacuum mode when the ambient air temperature is generally less than the second air setpoint, and initiates the intermittent operation in the pressure mode when the ambient air temperature is generally greater than the second air setpoint. The method includes environmental parameters of ambient air temperature and a soil temperature. The first and second air setpoints represent prescribed ambient air temperatures, and first and second soil setpoints represent turf soil temperatures. The method operates and blower units in the intermittent operation in response to comparing the ambient air temperature to the first and second air setpoints, and comparing the soil temperature to the first and second soil setpoints. The method operates intermittent operation in the vacuum mode when the ambient air temperature is generally greater than the first air setpoint and the soil temperature is generally less than the second soil setpoint. The method operates the cycles of intermittent operation in the pressure mode when the ambient air temperature is generally greater than the first air setpoint and the soil temperature is generally greater than the first soil setpoint.

More particularly, the method operates the aeration subsystem in the cycles of intermittent operation in the vacuum mode when one of the following occurs (1) the ambient temperature is generally greater than the second air setpoint and the soil temperature is generally less that the first soil setpoint, (2) the ambient temperature is generally less than the first air setpoint and the soil temperature is generally greater than the second soil setpoint, (3) the ambient temperature is generally greater than the first air setpoint and generally less than the second air setpoint, and the soil temperature is generally less than the first soil setpoint, (4) the ambient temperature is generally greater than the first air setpoint and generally less than the second air setpoint, and the soil temperature is generally greater than the second soil setpoint, and (5) the ambient temperature is generally greater than the first air setpoint and generally less than the second air setpoint, and the soil temperature is generally greater than the first soil setpoint and generally less than the second soil setpoint.

In regard to the pressure mode, the method operates the aeration subsystems in the cycles of intermittent operation in the pressure mode when one of the following occurs (1) the ambient temperature is generally greater than the second air setpoint and the soil temperature is generally greater than the second soil setpoint, (2) the ambient temperature is generally less than the first air setpoint and the soil temperature is generally greater than the first soil setpoint and generally less than the second soil setpoint, (3) the ambient temperature is generally greater than the second air setpoint and the soil temperature is generally greater than the first soil setpoint and generally less than the second soil setpoint, (4) the ambient temperature is generally greater than the first air setpoint and generally less than the second air setpoint, and the soil temperature is generally greater than the second soil setpoint.

In the above methods for conditioning the turf of a specific area, the method advantageously may include providing control modules responsive to a directive, and to the ambient air and soil temperatures. The control modules are connected to the aeration subsystems at the areas of interest, and controlling the operation thereof at one or more specific areas. The method may comprise repeating from time to time the determining step, and while the determination is positive, directing the local control modules to operate the aeration subsystems. A programmable master control module is provided in communication with the control modules, and the method receives at the master control module information sent from the control module representing the ambient air temperature and the soil temperature. When the determinative step is positive, the programmable master control module issues a directive to the local control module to operate the aeration subsystem.

As is evident from the disclosure above, systems and methods embodying principles of the invention provide an effective means for treating areas of interest to affect a desired soil temperature changes, oxygenation, and carbon dioxide reduction. At the same time, the systems can be utilized to promote drainage in these regions as well as providing for turf root zone aeration. The systems can be easily retrofitted to existing golf greens or other similar underground drainage systems or incorporated into new construction.

Those of ordinary skill will recognize that many functions of electrical and electronic apparatus can be implemented in hardware (for example, hard-wired logic), in software (for example, logic encoded in a program operating on a general purpose processor), and in firmware (for example, logic encoded in a non-volatile memory that is invoked for operation on a processor as required). The present invention contemplates the substitution of one implementation of hardware, firmware and software for another implementation of the equivalent functionality using a different one of hardware, firmware and software. To the extent that an implementation can be represented mathematically by a transfer function, that is, a specified response is generated at an output terminal for a specific excitation applied to an input terminal of a "black box" exhibiting the transfer function, any implementation of the transfer function, including any combination of hardware, firmware and software implementations of portions or segments of the transfer function, is contemplated herein.

While a preferred embodiment of the invention has been described using specific terms, such description is for illustrative purposes only, and it is to be understood that changes and variations may be made without departing from the spirit or scope of the following claims.

The invention claimed is:

1. A system for managing the turf condition and oxygen level of a plurality of areas of interest within a golf course, comprising:

a plurality of aeration subsystems associated with a plurality of the areas of interest;

said aeration subsystems including subsurface aeration conduits for providing aeration to said areas, and air blower units in fluid communication with said subsurface aeration conduits configured to provide one of a vacuum in a vacuum mode and air under pressure in a pressure mode in said aeration conduits;

local control modules responsive to a directive for controlling operation of said aeration subsystems in response to sensing environmental parameters at said golf course areas;

said control modules operating said blower units in repetitive cycles of intermittent operation in one of said vacuum mode and pressure mode wherein each cycle includes a blower-on mode and a blower-off mode;

said blower-on mode operating said blower units for a first time interval and said blower-off mode ceasing operation of said blower units for a second time interval during each of said cycles; and a master control module in communication with said local control modules;

said master control module receiving area information including said sensed environmental parameters from said local control modules and issuing directives to said local control modules to operate said aeration subsystems in said cycles of intermittent operation.

2. The system of claim 1 wherein said control module terminates said cycles of intermittent operation in response to detecting one of a predetermined environmental condition and operational condition.

3. The system of claim 2 wherein said environmental condition is one of soil moisture content and ambient air temperature.

4. The system of claim of claim 2 wherein said operational condition includes an overriding operation of said aeration subsystem selected by an attendant.

5. The system of claim 1 wherein said sensed environmental parameter includes ambient air temperature and including a first air setpoint representing a prescribed ambient air temperature, and said master control module issues a directive to one or more control modules for operating said aeration subsystems to draw air downwardly through the specific area under a vacuum when during said intermittent operation cycles when said ambient air temperature is generally greater than said first air setpoint.

6. The system of claim 5 wherein said sensed environmental parameter includes a second air setpoint representing a prescribed ambient air temperature, said control module initiates said intermittent operation in said pressure mode when said ambient air temperature is generally greater than said second air setpoint, and said first air setpoint is generally less than said second air setpoint.

7. The system of claim 1 wherein said sensed environmental parameter includes ambient air temperature and including a first air setpoint and a second air setpoint representing prescribed ambient air temperatures, said control module initiates said intermittent operation in said pressure mode when said ambient air temperature is generally greater than said second air setpoint, and said first air setpoint is generally less than said second air setpoint.

8. The system of claim 1 including environmental parameters of ambient air temperature and soil temperature, and said directive causes said aeration subsystem to establish said vacuum in said aeration conduit so that air is drawn downward though the soil at the area of interest when said ambient temperature is generally greater than said soil temperature.

9. The system of claim 1 including environmental parameters of ambient air temperature and a soil temperature, wherein said directive instructs said aeration subsystem to establish an air flow under pressure in said aeration conduit at the area of interest when the air temperature is generally less than the soil temperature.

10. The system of claim 9 including an environmental parameter of moisture content and wherein said directive instructs said aeration subsystem to establish said air flow under pressure in said aeration conduct when said soil moisture content is below a moisture setpoint.

11. The system of claim 1 including environmental parameters of ambient air temperature and a soil temperature, first and second air setpoints representing prescribed ambient air temperatures, first and second soil setpoints representing prescribed soil temperatures, and said control module operating said blower units in said cycles of intermittent operation in response to comparing said ambient air temperature to said first and second air setpoints, and comparing said soil temperature to said first and second soil setpoints.

12. The system of claim 11 wherein said control module operates said intermittent operation in said vacuum mode when the ambient air temperature is generally greater than said first air setpoint and said soil temperature is generally less than said second soil setpoint.

13. The system of claim 12 wherein said control module operates said intermittent operation in said pressure mode when the ambient air temperature is generally greater than said first air setpoint and said soil temperature is generally greater than said first soil setpoint.

14. The system of claim 11 including a second air setpoint for ambient air temperature and a second soil setpoint for soil temperature; and said control module initiates intermittent operation in said vacuum mode when one of the following occurs (1) said ambient temperature is generally greater than said second air setpoint and said soil temperature is generally less that said first soil setpoint, (2) said ambient temperature is generally less than said first air setpoint and said soil temperature is generally greater than said second soil setpoint, (3) said ambient temperature is generally greater than said first air setpoint and generally less than said second air setpoint, and said soil temperature is generally less than said first soil setpoint, (4) said ambient temperature is generally greater than said first air setpoint and generally less than said second air setpoint, and said soil temperature is generally greater than said second soil setpoint, and (5) said ambient temperature is generally greater than said first air setpoint and generally less than said second air setpoint, and said soil temperature is generally greater than said first soil setpoint and generally less than said second soil setpoint.

15. The system of claim 14 including an environmental parameter of ambient air temperature and a soil temperature; first and second air setpoints for ambient air temperature; first and second soil setpoints for soil temperature; and said control module initiates intermittent operation in said pressure mode when one of the following occurs (1) said ambient temperature is generally greater than said second air setpoint and said soil temperature is generally greater than said second soil setpoint, (2) said ambient temperature is generally less than said first air setpoint and said soil temperature is generally greater than said first soil setpoint and generally less than said second soil setpoint, (3) said ambient temperature is generally greater than said second air setpoint and said soil temperature is generally greater than said first soil setpoint and generally less than said second soil setpoint, (4) said ambient temperature is generally greater than said first air setpoint and generally less than said second air setpoint, and said soil temperature is generally greater than said second soil setpoint.

16. The system of claim 11 including an environmental parameter of ambient air temperature and a soil temperature; first and second air setpoints for ambient air temperature; first and second soil setpoints for soil temperature; and said control module initiates intermittent operation in said pressure mode when one of the following occurs (1) said ambient temperature is generally greater than said second air setpoint and said soil temperature is generally greater than said second soil setpoint, (2) said ambient temperature is generally less than said first air setpoint and said soil temperature is generally greater than said first soil setpoint and generally less than said second soil setpoint, (3) said ambient temperature is generally greater than said second air setpoint and said soil temperature is generally greater than said first soil setpoint and generally less than said second soil setpoint, (4) said ambient temperature is generally greater than said first air setpoint and generally less than said second air setpoint, and said soil temperature is generally greater than said second soil setpoint.

17. A system for conditioning and oxygenating turf of a playing field having a soil profile comprising:

an aeration subsystem having a plurality of perforated aeration conduits disposed below the turf in fluid communication with said turf;

an air blower unit operatively connected to said aeration conduits for establishing one of a vacuum in a vacuum mode and air under pressure in a pressure mode in said conduits;

a control module for controlling the operation of said blower unit to establish said one of a vacuum mode and a pressure mode in said aeration conduits in response to sensing an ambient air temperature;

said control module operating said blower unit in repetitive cycles of intermittent operation wherein each cycle includes a blower-on mode and a blower-off mode during said one of a vacuum mode and pressure mode; and said blower-on mode operating said blower for a first time interval and said blower-off mode ceasing operation of said blower for a second time interval during each of said cycles.

18. The system of claim 17 wherein said control module includes an intermittent control circuit for automatically controlling the operation of said blower unit to establish one of said vacuum mode and pressure mode in said aeration conduits, said control circuit comprising;

a repeat cycle timer for connecting said blower unit to operate in repeat cycles of intermittent operation which includes a blower-on mode and a blower-off mode;

a thermal switch circuit connected to said cycle timer for operating said blower unit in response to the ambient air temperature in one of said vacuum mode and pressure mode during said cycles of intermittent operation; and said cycle timer circuit operating said blower for a first time interval in said blower-on mode and ceasing operation of said blower for a second time interval in said blower-off mode during said repeat cycles.

19. The system of claim 18 wherein said thermal switch circuit includes a multi-stage thermal switch having a first temperature setpoint and a second temperature setpoint, said thermal switch circuit operates said blower unit in said vacuum mode when said ambient air temperature is generally above said first air setpoint and below said second air setpoint, and said thermal switch circuit operates said blower unit in said pressure mode when said ambient air temperature is generally above said second air setpoint.

20. The system of claim 19 wherein said intermittent control circuit includes a time delay circuit for delaying operation of said blower unit in said pressure mode to provide ample time for said blower unit to be mechanically reconfigured for pressure mode operation.

21. The system of claim 18 wherein said control circuit includes a manual override circuit which overrides the automatic operation of said blower unit and provides for manual switching between said vacuum mode and pressure mode intermittent operation.

22. The system of claim 18 wherein said control circuit includes a automatic override circuit which terminates automatic operation of said cycles of intermittent operation in response to detecting one of a predetermined environmental condition and operational condition.

23. The system of claim 17 including a temperature sensor for sensing said ambient temperature and communicating the ambient temperature to said control module.

24. The system of claim 23 including a first air setpoint, and said control module initiates said cycles of intermittent operation when said ambient temperature is generally greater than said first air setpoint.

25. The system of claim 24 including a second air setpoint, and said controller module initiates operation of said cycles of intermittent operation in said vacuum mode when said ambient air temperature is generally less than said second air setpoint, and initiates operation of said intermittent operation in said pressure mode when said ambient air temperature is generally greater than said second air setpoint.

26. The system of claim 17 wherein said control module terminates operation of said cycles of intermittent operation in response to detecting one of a predetermined environmental condition and operational condition.

27. The system of claim of claim 26 wherein said environmental condition includes one of a soil moisture content ambient air temperature.

28. The system of claim of claim 26 wherein said operational condition includes one of an overriding operation of said aeration subsystem selected by an attendant.

29. The system of claim 17 including environmental parameters of ambient air temperature and a soil temperature, first and second air setpoints representing prescribed ambient air temperatures, first and second soil setpoints representing prescribed soil temperatures, and said control module operating said blower units in said cycles of intermittent operation in response to comparing said ambient air temperature to said first and second air setpoints, and comparing said soil temperature to said first and second soil setpoints.

30. The system of claim 29 wherein said control module operating said intermittent operation in said vacuum mode when the ambient air temperature is generally greater than said first air setpoint and said soil temperature is generally less than said second soil setpoint.

31. The system of claim 29 including operating said intermittent operation in said pressure mode when the ambient air temperature is generally greater than said first air setpoint and said soil temperature is generally greater than said first soil setpoint.

32. The system of claim 29 including a second air setpoint for ambient air temperature and a second soil setpoint for soil temperature; and said method initiates said intermittent operation of said aeration subsystem in said vacuum mode when one of the following occurs (1) said ambient temperature is generally greater than said second air setpoint and said soil temperature is generally less that said first soil setpoint, (2) said ambient temperature is generally less than said first air setpoint and said soil temperature is generally greater than said second soil setpoint, (3) said ambient temperature is generally greater than said first air setpoint and generally less than said second air setpoint, and said soil temperature is generally less than said first soil setpoint, (4) said ambient temperature is generally greater than said first air setpoint and generally less than said second air setpoint, and said soil temperature is generally greater than said second soil setpoint, and (5) said ambient temperature is generally greater than said first air setpoint and generally less than said second air setpoint, and said soil temperature is generally greater than said first soil setpoint and generally less than said second soil setpoint.

33. The system of claim 30 including an environmental parameter of ambient air temperature and a soil temperature; first and second air setpoints for ambient air temperature; first and second soil setpoints for soil temperature; and said control module initiates intermittent operation in said pressure mode when one of the following occurs (1) said ambient temperature is generally greater than said second air setpoint and said soil temperature is generally greater than said second soil setpoint, (2) said ambient temperature is generally less than said first air setpoint and said soil temperature is generally greater than said first soil setpoint and generally less than said second soil setpoint, (3) said ambient temperature is generally greater than said second air setpoint and said soil temperature is generally greater than said first soil setpoint and generally less than said second soil setpoint, (4) said ambient temperature is generally greater than said first air setpoint and generally less than said second air setpoint, and said soil temperature is generally greater than said second soil setpoint.

34. The system of claim 29 including an environmental parameter of ambient air temperature and a soil temperature; first and second air setpoints for ambient air temperature; first and second soil setpoints for soil temperature; and said control module initiates intermittent operation in said pressure mode when one of the following occurs (1) said ambient temperature is generally greater than said second air setpoint and said soil temperature is generally greater than said second soil setpoint, (2) said ambient temperature is generally less than said first air setpoint and said soil temperature is generally greater than said first soil setpoint and generally less than said second soil setpoint, (3) said ambient temperature is generally greater than said second air setpoint and said soil temperature is generally greater than said first soil setpoint and generally less than said second soil setpoint, (4) said ambient temperature is generally greater than said first air setpoint and generally less than said second air setpoint, and said soil temperature is generally greater than said second soil setpoint.

35. A system for conditioning and oxygenating turf of a playing field having a soil profile comprising:

an aeration subsystem having a plurality of perforated aeration conduits disposed below the turf in fluid communication with said turf;

an air blower unit operatively connected to said aeration conduits for establishing one of a vacuum in a vacuum mode and air under pressure in a pressure mode in said conduits;

a control module having an intermittent control circuit for automatically controlling the operation of said blower unit to establish said one of a vacuum mode and a pressure mode in said aeration conduits, said control circuit comprising;

a repeat cycle timer for connecting said blower unit to operate in repeat cycles of intermittent operation which includes a blower-on mode and a blower-off mode;

a thermal switch circuit connected to said cycle timer for operating said blower unit in response to the ambient air temperature in one of said vacuum mode and pressure mode during said cycles of intermittent operation; and said cycle timer circuit operating said blower for a first time interval in said blower-on mode and ceasing operation of said blower for a second time interval in said blower-off mode during said repeat cycles.

36. The system of claim 35 wherein said thermal switch circuit includes a multi-stage thermal switch having a first temperature setpoint and a second temperature setpoint, said thermal switch circuit operates said blower unit in said vacuum mode when said ambient air temperature is generally above said first air setpoint and below said second air setpoint, and said thermal switch circuit operates said blower unit in said pressure mode when said ambient air temperature is generally above said second air setpoint.

37. The system of claim 36 wherein said intermittent control circuit includes a time delay circuit for delaying operation of said blower unit in said pressure mode to provide ample time for said blower unit to be mechanically reconfigured for pressure mode operation.

38. The system of claim 35 wherein said control circuit includes a manual override circuit which overrides the automatic operation of said blower unit and provides for manual switching between said vacuum mode and pressure mode intermittent operation.

39. The system of claim 35 wherein said control circuit includes a automatic override circuit which terminates automatic operation of said cycles of intermittent operation in response to detecting one of a predetermined environmental condition and operational condition.

40. A computerized method for conditioning and oxygenating turf at an area of interest within a golf course comprising the steps of:

providing an aeration subsystem at the golf course area which includes a perforated aeration conduit disposed below the turf, a blower unit in fluid communication with the aeration conduit configured to establish one of a vacuum in a vacuum mode and air under pressure in a pressure mode in said aeration conduit, a control modular for controlling operation of said aeration subsystem, and a sensor that measures the ambient air temperature;

determining whether a condition exists for one of reducing and increasing the temperature of the soil at the area in response to the ambient air temperature;

if the condition exists, operating said aeration subsystem to create one of a vacuum mode and a pressure mode in said aeration conduit for one of reducing or increasing a temperature of turf at the area; and operating said blower units in repetitive cycles of intermittent operation during said one of said vacuum mode and pressure mode wherein each cycle includes a blower-on mode and a blower-off mode; and said blower-on mode operating said blower units for a first time interval and said blower-off mode discontinuing operation of said blower units for a second time interval during each of said repetitive cycles.

41. The method of claim 40 including terminating said cycles of intermittent operation of said aeration subsystem in response to detecting one of a predetermined environmental condition and operational condition.

42. The method of claim 41 wherein said environmental condition includes one of a soil moisture content and an ambient air temperature.

43. The method of claim 40 including a first air setpoint, and said method initiates said intermittent operation of said aeration subsystem when said ambient temperature is generally greater than said first air setpoint.

44. The method of claim 43 including a second air setpoint, and said method initiates said cycles of intermittent operation in said vacuum mode when said ambient air temperature is generally less than said second air setpoint, and initiates said cycles of intermittent operation in said pressure mode when said ambient air temperature is generally greater than said second air setpoint.

45. The method of claim 40 including environmental parameters of ambient air temperature and a soil temperature; first and second air setpoints representing prescribed ambient air temperatures, and first and second soil setpoints representing turf soil temperatures; and said method operates said blower units in said cycles of intermittent operation in response to comparing said ambient air temperature to said first and second air setpoints, and comparing said soil temperature to said first and second soil setpoints.

46. The method of claim 45 including operating said cycles of intermittent operation in said vacuum mode when the ambient air temperature is generally greater than said first air setpoint and said soil temperature is generally less than said second soil setpoint.

47. The method of claim 45 including operating said cycles of intermittent operation in said pressure mode when the ambient air temperature is generally greater than said first air setpoint and said soil temperature is generally greater than said first soil setpoint.

48. The method of claim 45 including operating said aeration subsystem in said cycles of intermittent operation in said vacuum mode when one of the following occurs (1) said ambient temperature is generally greater than said second air setpoint and said soil temperature is generally less that said first soil setpoint, (2) said ambient temperature is generally less than said first air setpoint and said soil temperature is generally greater than said second soil setpoint, (3) said ambient temperature is generally greater than said first air setpoint and generally less than said second air setpoint, and said soil temperature is generally less than said first soil setpoint, (4) said ambient temperature is generally greater than said first air setpoint and generally less than said second air setpoint, and said soil temperature is generally greater than said second soil setpoint, and (5) said ambient temperature is generally greater than said first air setpoint and generally less than said second air setpoint, and said soil temperature is generally greater than said first soil setpoint and generally less than said second soil setpoint.

49. The method of claim 48 including operating said aeration subsystems in said cycles of intermittent operation in said pressure mode when one of the following occurs (1) said ambient temperature is generally greater than said second air setpoint and said soil temperature is generally greater than said second soil setpoint, (2) said ambient temperature is generally less than said first air setpoint and said soil temperature is generally greater than said first soil setpoint and generally less than said second soil setpoint, (3) said ambient temperature is generally greater than said second air setpoint and said soil temperature is generally greater than said first soil setpoint and generally less than said second soil setpoint, (4) said ambient temperature is generally greater than said first air setpoint and generally less than said second air setpoint, and said soil temperature is generally greater than said second soil setpoint.

50. The method of claim 45 including operating said aeration subsystem in said cycles of intermittent operation in said pressure mode when one of the following occurs (1) said ambient temperature is generally greater than said second air setpoint and said soil temperature is generally greater than said second soil setpoint, (2) said ambient temperature is generally less than said first air setpoint and said soil temperature is generally greater than said first soil setpoint and generally less than said second soil setpoint, (3) said ambient temperature is generally greater than said second air setpoint and said soil temperature is generally greater than said first soil setpoint and generally less than said second soil setpoint, (4) said ambient temperature is generally greater than said first air setpoint and generally less than said second air setpoint, and said soil temperature is generally greater than said second soil setpoint.

* * * * *